United States Patent [19]

Spademan

[11] 4,426,796

[45] Jan. 24, 1984

[54] SPORT SHOE WITH A DYNAMIC FITTING SYSTEM

[76] Inventor: Richard G. Spademan, P.O. Box 6410, Incline Village, Nev. 89450

[21] Appl. No.: 227,393

[22] Filed: Jan. 22, 1981

Related U.S. Application Data

[63] Continuation-in-part of Ser. No. 109,611, Jan. 4, 1980, and Ser. No. 104,283, Dec. 17, 1979, and Ser. No. 104,282, Dec. 17, 1979, and Ser. No. 50,436, Jun. 20, 1979, and Ser. No. 886,946, Mar. 15, 1978.

[51] Int. Cl.[3] ..... A43B 5/04

[52] U.S. Cl. ..... 36/119

[58] Field of Search ..... 36/119, 120, 121

[56] References Cited

U.S. PATENT DOCUMENTS 3,883,964 5/1975 Check ..... 36/119

4,205,467 6/1980 Salomon ..... 36/119

4,253,251 3/1981 Salomon ..... 36/119

*Primary Examiner*—Patrick D. Lawson

*Attorney, Agent, or Firm*—Townsend and Townsend

[57] ABSTRACT

A sport shoe (1, 101, 201, 400, 500, 600, 650, 700, 750, 780, 800, 850, 900, 950) is disclosed comprising a dynamic fitting system responsive to wearer movement. In various embodiments of the shoe there is provided movable strap members (17, 19), a movable instep tongue member (163, 263), a movable footbed (412, 516, 605, 705, 784), a movable tongue and heel receiving member (860, 861), adjustable cuff members (701) and interior and exterior tongue assemblies (915, 920). In use the above members in response to wearer movement tighten momentarily the fit of the sport shoe from a close fit.

60 Claims, 46 Drawing Figures

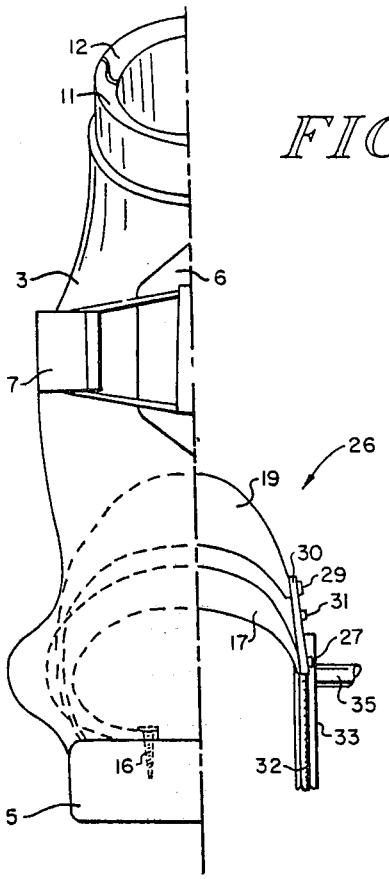
FIG. 5
FIG. 4
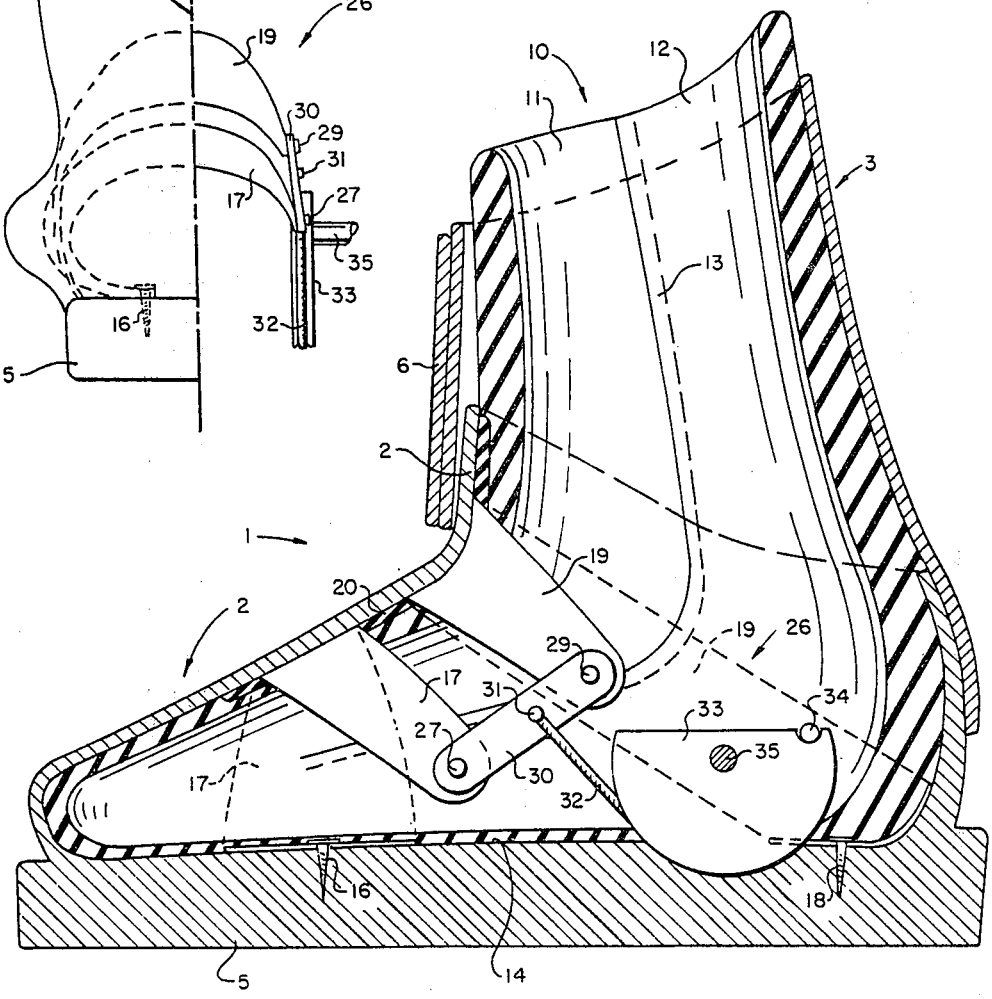

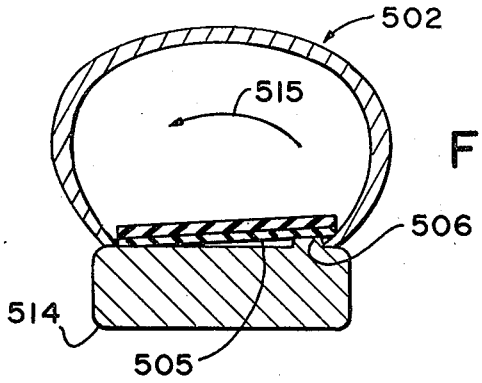
FIG. 16
FIG. 15
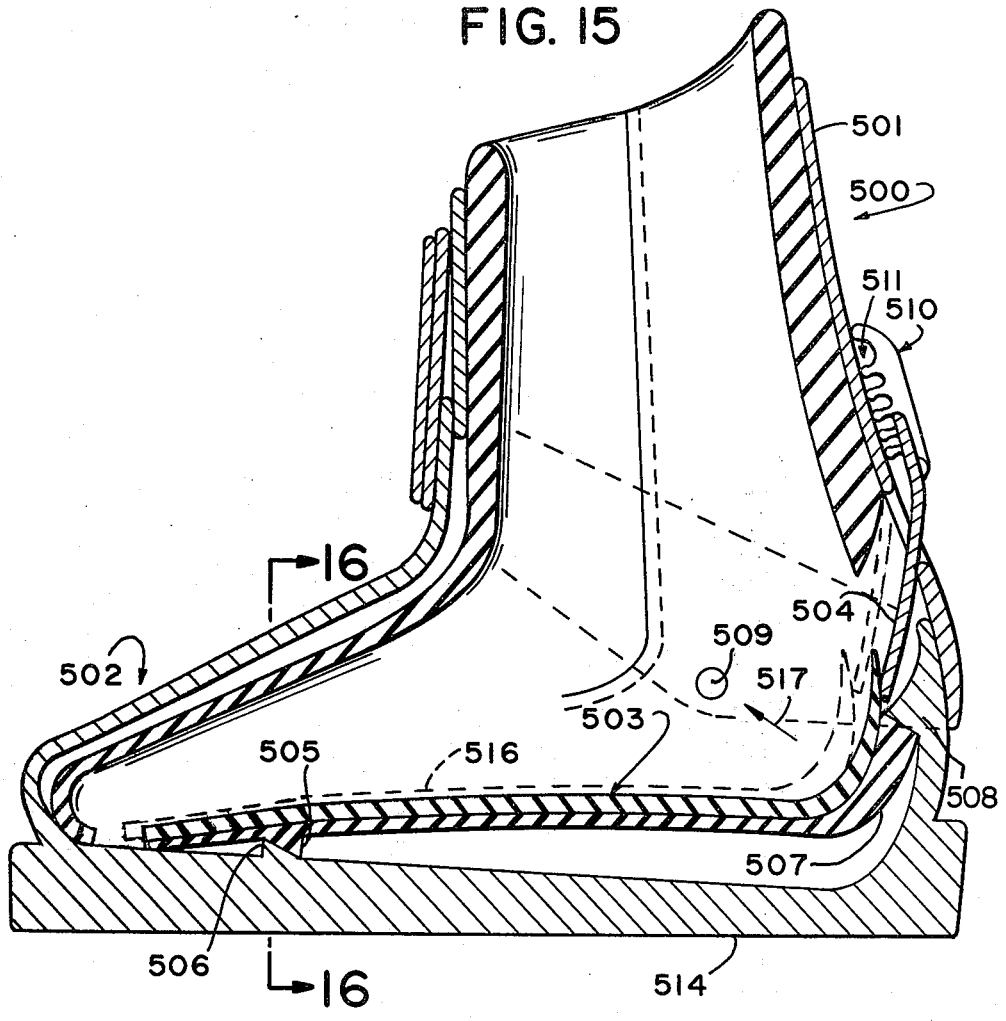

FIG. 32
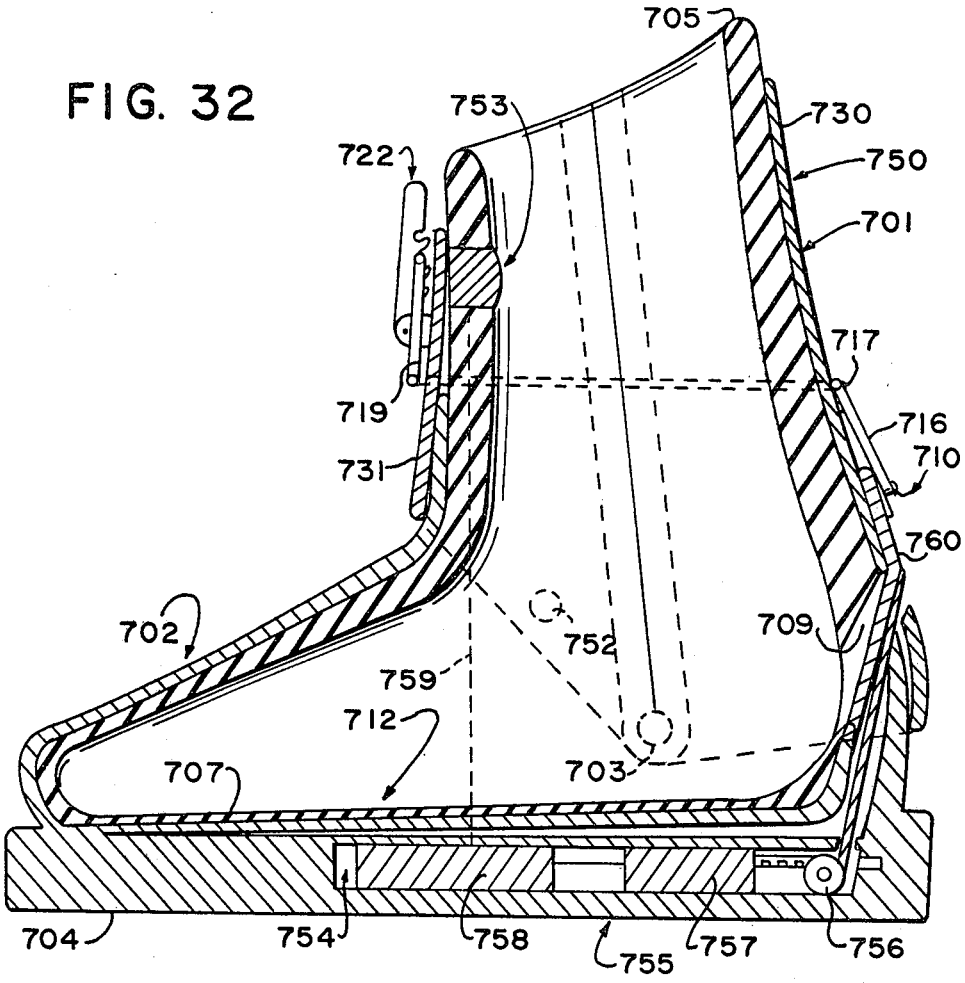
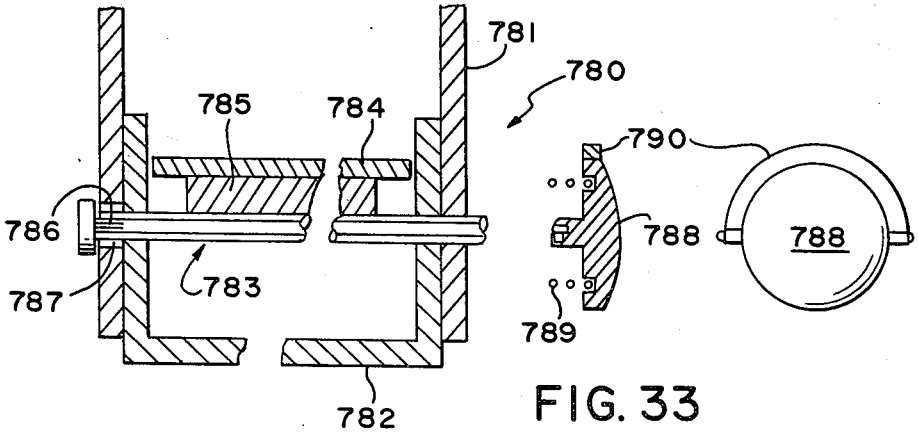
FIG. 33

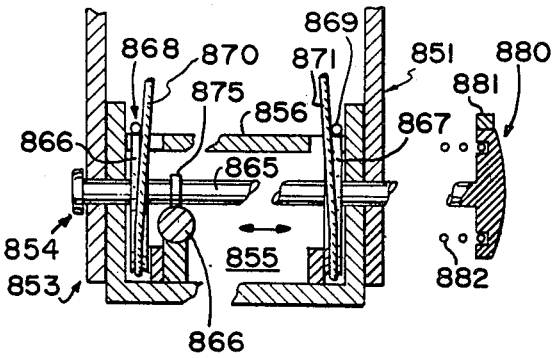
FIG. 38
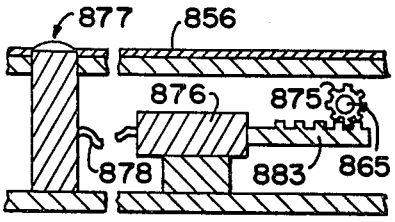
FIG. 39
FIG. 37
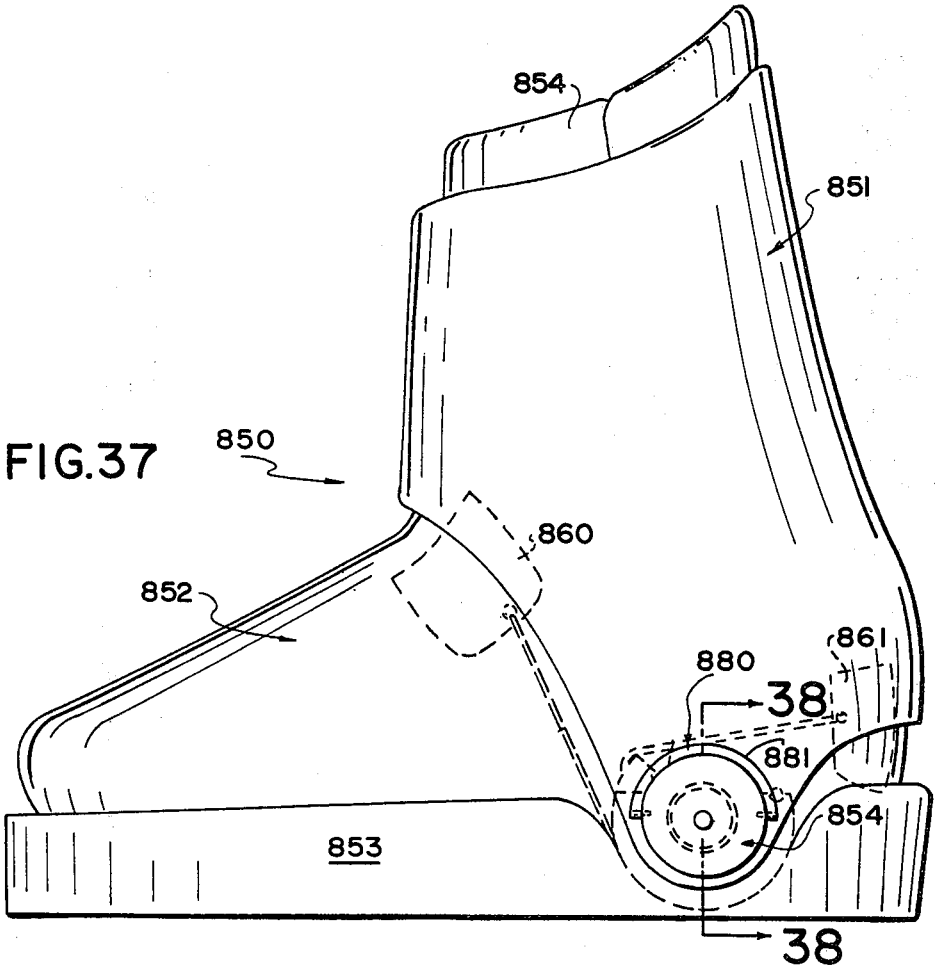

SPORT SHOE WITH A DYNAMIC FITTING SYSTEM

RELATED APPLICATIONS

The present application is a continuation-in-part of applicant's United States patent applicaton Ser. No. 109,611 filed Jan. 4, 1980 entitled "A Sport Shoe With A Dynamic Adjustable Cuff Assembly", applicant's application Ser. No. 104,283 filed Dec. 17, 1979 entitled "A Dynamic Internal Fitting System For A Sport Shoe", applicant's application Ser. No. 104,282 filed Dec. 17, 1979 entitled "Sport Shoe With Dynamic Tongue Assembly," applicant's application Ser. No. 50,436 filed June 20, 1979 entitled "A Dynamic Internal Fitting System With A Movable Foot Bed For A Sport Shoe", and applicant's application Ser. No. 886,946, filed Mar. 15, 1978 and entitled "A Dynamic Fitting System for a Support Shoe".

BACKGRAOUND OF THE INVENTION

The present invention relates to fitting systems for sport shoes in general and in particular to a novel dynamic fitting system for a ski boot or the like.

A conventional ski boot as presently used in downhill skiing with a ski release binding typically comprises a relatively rigid exterior lower shell member and upper cuff member and a relatively soft interior liner. The shell member and cuff member are designed to provide mechanical protection and support for a foot, ankle and lower leg and to provide a stable means for releasably securing the boot to a ski.

Usually the shell member and cuff member are pivotally coupled in the proximity of the ankle as by a rivet or the like. Boots constructed with a pivoting cuff member generally provide restraint against excess sideways and rearward bending of the leg relative to the foot at the ankle while providing limited forward bending thereof. Less commonly, boots are constructed without a pivoting cuff member and forward bending is accommodated by a separation of the upper forward section of the cuff member.

The relatively rigid exterior lower shell member and upper cuff member in conjunction with the relatively soft interior liner in conventional ski boots are designed to also provide restraint against upward, forward, rearward and sideways movement of the foot. This restraint is necessary to minimize foot discomfort and fatigue from recurring pressure areas anc continual movement of the foot in the boot and to control the skis during various skiing maneuvers and in various terrain and snow conditions. Furthermore, this restraint is essential to minimize foot movement in order to maximize energy transmission between the foot and the release binding in a potential injury producing fall.

In practice, the magnitude of the restraint required from one moment to the next will vary as the skiing conditions and the maneuvers being executed change. Consequently, an ideal boot should provide for a close, comfortable fit that does not compromise circulation and warmth for the tracking phase of skiing and provides a momentary tighter fit for the turning phase of skiiing and during a fall condition.

As presently designed, conventional ski boots do not adequately compensate for the dynamic conditions that prevail in downhill skiing. With conventional boots, during a turn when skiing on packed snow, forward bending at the ankle is usually accompanied by a tendency for hindfoot upward movement and forefoot sideways movement because ski control and turning are usually accomplished by downward and sideways force applied to the forward leading edges of the skis. In powder snow, the forward leading edges are kept raised for planing on top of the snow with a tendency for forefoot upward and sideways movement. When maneuvering in snow of different consistencies or in bumpy or mogly terrain, the skier alternates, frequently and rapidly, between forward and rearward bending in the boots. As a result of this foot movement, ski control with conventional ski boots is significantly reduced. In most injury producing fall conditions, excess movement also reduces energy transmission between the foot and the release binding.

To provide for a close fit which is necessary for controlling a ski during turns and the like while also providing for adequate warmth and comfort during other skiing manuevers, manufacturers have been required to provide boots with various sized shells. Because shell molds are expensive to manufacture, however, it has been the practice of manufacturers to supply only a limited number of shell sizes and instead, to rely upon buckles with numerous and complex adjustments and liners of various configurations and constructions to provide a close, comfortable and warm fit, to compensate for innumerable foot sizes and shapes, and to achieve the necessary foot restraint. As a rule, however, the use of buckles and liners to achieve a close fit during all phases of skiing has been unsatisfactory. The use of buckles with numerous and complex adjustments usually results in a nonconforming fit. The buckle closures required to provide a close fit also usually results in uncomfortable pressure areas because of the consequent distortion of the relatively rigid shell. Additionally, conventional buckle arrangements usually do not adequately restrain the foot from sideways movement as the hindfoot and forefoot.

The use of liners of various configurations and constructions also often results in a nonconforming fit. Because of the difficulty in supplying liner configurations that will accommodate the wide range of variation of foot sizes and shapes such as a splay or wide forefoot, wide base, angulated heel, halux valgus, boney prominences, spurs, high longitudinal arch or one foot in size variance with the other foot, liners are generally manufactured to conform to only a limited range of size and shape. Manufacturers then rely upon various liner constructions to provide a close comfortable fit. Among the constructions used there are included molded and sheet foam rubber, urethane foam, wax, cork, plastic beads, and other various flow materials. The numerous materials used is indicative of the unsatisfactory results.

In spite of the above fitting arrangements, conventional boots do not provide adequate adjustment for comfort and restraint and a relatively large inventory of many shells and liner configurations and constructions is necessary to satisfy customer requirements. Moreover, a satisfactory fit in the ski shop is still often unsatisfactory on the ski slope because the foot is not necessarily fitted for skiing conditions.

There have been several proposals for simplifying the closure and fitting system in ski boots.

One of the proposals for a ski boot which provides a simplified closure and fitting system is disclosed in Salomon U.S. Pat. No. 4,160,332. In Salomon the foot retaining system comprises means attached to a hinged rear part of the boot for bearing against the foot as the rear hinged part is closed to a rigid front shell. After the hinged part is closed to the shell, the foot is immobilized in a nonmovable fitting system in the boot shell. As a consequence, there is no means possible in the Salomon disclosure for dynamically momentarily tightening the fitting system of a ski boot from the closed position.

In Gertsch, U.S. Pat. No. 3,793,749, corresponding to German Pat. No. 2,317,408 discussed in the above identified Salomon patent, there is disclosed a ski boot comprising a flexible pliable inner upper and a pair of bending-resistant outer uppers. One outer upper is arranged at the region of the vamp and the other outer upper is arranged at the region of the quarter. The outer uppers are coupled to one another by means of a traction element which transmits the closing movement of one outer upper as a closing movement to the other outer upper portion. After the outer uppers are closed, the flexible resilient inner upper allows the outer uppers to move and the foot to remain mobile in a movable fitting system. As a consequence there is no means possible in the Gertsch disclosure for preventing loosening of the fit from a closed position.

Moreover, due to the relatively unrestricted rearward movement of the outer upper because of the flexible pliable nature of the inner upper, adequate ski control is, under all skiing conditions, seriously impaired. Indeed, as a practical matter, it is not possible with a Gertsch-type boot to maintain the close fit necessary to retain ski control during changing skiing maneuvers as in rapidly changing terrain and snow conditions.

SUMMARY OF THE INVENTION

In view of the foregoing, a principal object of the present invention is a sport shoe with an adjustable fitting system, and in particular, a sport shoe such as a ski boot, with a dynamic fitting system which reduces the number of shell sizes, liner configurations and constructions otherwise required to achieve a close comfortable and warm fit, and which provides the necessary foot restraint over a wide range of foot sizes and foot shapes during use thereof.

Another object of the present invention is a sport shoe with a fitting system that requires a minimum of adjustments to fit a foot.

Another object of the present invention is a sport shoe with a fitting system that may be easily and rapidly adjusted to a foot.

Another object of the present invention is a sport shoe with a fitting system that may be adjusted from outside of the shoe.

Another object of the present invention is a sport shoe with a fitting system that may be readily opened and closed allowing easy insertion and removal of a foot from the shoe.

Still other objects of the present invention include the following:

A sport shoe with a fitting system that changes shape dynamically in response to wearer movement.

A sport shoe with a fitting system for use in skiing that accommodates hindfoot upward movement during a turning phase of skiing by becoming tighter at the forefoot.

A sport shoe with a fitting system for use in skiing that accommodates to forward lean during a turning phase of skiing by becoming tighter at the hindfoot and forefoot.

A sport shoe with a fitting system for use in skiing that accommodates to forefoot upward movement during a turning phase of skiing by becoming tighter at the hindfoot.

A sport shoe with a fitting system that accommodates to a potential injury producing fall by becoming tighter at the hindfoot and forefoot.

A sport shoe with a fitting system that is elastic and absorbs shock.

A sport shoe with a fitting system that is not affected adversely by temperature and provides for dead air space insulation.

A sport shoe with a fitting system that is lightweight and is inexpensive to manufacture.

In accordance with the above objects, there is provided in an embodiment of the present invention an improved downhill ski boot. In the ski boot there is provided a lower shell member including a sole member, an upper cuff member movably attached to the lower shell member and a pair of strap members. The first of the strap members is pivotably attached to the sole member at the forward end of the longitudinal arch of the boot, passes around the lateral aspect of the forefoot and over the dorsum and is connected to the forward end of an elongated pivotable linking member. The second strap member is pivotally attached to the sole member at the rearward end of the longitudinal arch, passes around the lateral aspect of the heel and over the instep and is connected to the rearward end of the linking member. The linking member is located on the superior medial aspect of the longitudinal arch. A cable is pivotally connected to the linking member intermediate the strap members, extends along the medial aspect of the foot and is connected at its opposite end to a pulley. The pulley is located on the interior wall of the lower shell member and is releasably coupled to the upper cuff member. The length of cable wrapped about the pulley is adjusted by means of a knob member located on the exterior wall of the upper cuff member. The knob member is connected to the pulley by a shaft member which passes through a bore in the upper cuff member and lower shell member, and forms the pivot axis for the upper cuff member.

In initially fitting the ski boot, the knob member and pulley are rotated relative to the upper cuff member for manually selectively adjusting the length of cable wrapped about the pulley when the upper cuff member and lower shell member are in a given relative position. As the length of cable is adjusted, the linking member moves and pivots to accommodate the strap members to the foot size and shape. As the strap members are moved, they apply a force against the foot in a sideward, rearward and downward direction. Once the desired amount of tension is applied to the strap members in the given position, the knob and pulley are releasably locked to the upper cuff member.

During varioius skiing maneuvers, as the position of the foot changes in the boot, the linking member pivots and dynamically adjusts the tension applied to and the position of the strap members relative to the foot. Hindfoot upward movement causes the linking member to pivot in a counterclockwise direction tightening the strap member about the forefoot. Forefoot upward movement causes the linking member to pivot in a clockwise direction tightening the strap member about the hindfoot. Additionally, as the upper cuff member pivots forwardly relative to the lower shell member in forward lean, the pulley is rotated. As the pulley rotates, the length of cable wrapped about the pulley varies dynamically as a function of the relative position of the upper cuff member and lower shell member. As the length of cable wrapped about the pulley varies dynamically, the linking member further moves and pivots for adjusting and increasing the tension applied to and the position of the strap members relative to the foot.

In another embodiment of the present invention, a tongue member is provided for engaging the upper surface of a foot in the area of the instep. The tongue member extends forwardly to the midfoot and rearwardly to the lower third of the leg and medially and laterally to the malleoli. Connected to the tongue member intermediate the ends is a pair of cables. One end of each of the pair of cables is connected to each of the opposite lateral edges of the tongue member, respectively. The opposite end of the cables is connected to a corresponding pulley releasably coupled to the upper cuff member. In one embodiment, the pulleys are separately adjustable relative to the upper cuff member by means of a knob member which is provided for selectively adjusting the length of cable wrapped about the pulleys when the upper cuff member and lower shell member are in a given relative position. In another embodiment, the pulleys are attached to a common shaft and are adjusted together for selectively adjusting the length of cable wrapped about the pulleys. In each of the latter embodiments, the pulleys are releasably coupled to the upper cuff member for dynamically adjusting the tension applied to and the position of the tongue member relative to the foot engaged thereby.

In an alternative embodiment, there is provided a pulley connected to a linking member by a cable and a pair of strap members connected to the linking member and attached to the sole as described above. However, in this embodiment, instead of being attached to a cuff member, the pulley is releasably coupled to the lower shell member by a knob member located on the exterior wall of the lower shell member for selectively adjusting the length of cable wrapped about the pulley. By coupling the pulley to the lower shell member instead of the upper cuff member, the upper cuff member may pivot forwardly or rearwardly without affecting the fit of the boot. At the same time, any tendency for forefoot or hindfoot movement is compensated for by a redistribution of the foot restraining forces by the linking and strap members.

In other embodiments of the present invention there is provided a movable footbed for dynamically adjusting the fit of a sport shoe to a foot. In one of these embodiments, the movable footbed is pivotally supported at its forward end by means of a pivot member. At its rear end there is provided a fluid responsive piston assembly which is coupled to a hydraulic transducer located at the upper forward midline of a cuff member of the sport shoe. In use as pressure is brought to bear on the transducer the resulting increase in fluid pressure therein moves the piston assembly raising the rear end of the footbed. As the rear end of the footbed is raised the fit of the sport shoe is momentarily tightened. Means are also provided for initially adjusting the height of the footbed for a given amount of pressure exerted on the transducer.

In other embodiments of the present invention employing a movable footbed there is provided other means such as cables responsive to cuff movement for raising the footbed and means for moving the footbed in a forward direction relative to the sole of the sport shoe as the footbed is raised as well as means for rotating the footbed about an axis parallel to the longitudinal axis of the footbed.

In still other embodiments of the present invention employing a movable footbed there is provided means for adjusting the initial width and length of the footbed as well as the height of the arch of the footbed.

In still another embodiment of the present invention employing a movable footbed there is provided a means coupling the footbed to the cuff member for tightening the cuff member and the footbed as the lower extremity is moved.

In another embodiment of the present invention employing a movable footbed wherein the movable footbed and cuff member are coupled for tightening the cuff member as the lower extremity is moved there is provided transducer operated movable piston assemblies responsive to applied pressure for moving the footbed.

In still another embodiment of the present invention employing a movable footbed there is provided a shaft member releasably coupled to a cuff member and a plate member extending from the shaft member for engaging and moving the footbed as the cuff member is moved.

In still another embodiment of the present invention employing a movable footbed there is provided an instep member coupled to the footbed by means of strap members for dynamically adjusting the pressure of the instep member on an instep engaged thereby as the footbed is moved.

In still another embodiment of the present invention there is provided instep and heel engaging means which are coupled to a pulley assembly. Means are provided for coupling the pulley assembly to a movable cuff or a transducer activated movable piston assembly for moving the instep and heel engaging members in response to wearer movement for tightening momentarily the fit of a ski boot in response to said wearer movement.

In still another embodiment of the present invention there is provided a sport shoe comprising an inner tongue member and an outer tongue member and means for coupling the inner tongue member to the outer tongue member in a manner which provides for a mechanical advantage such that a given movement of the inner tongue member in response to wearer movement results in a larger movement of the outer tongue member which tightens the shell momentarily relative to a foot enclosed thereby.

In still another embodiment of the present invention employing a movable footbed in a running or jogging shoe there is provided means for raising the footbed as the footbed is moved in a rearward direction relative to an underlying sole member. The means provided comprises a plurality of facing wedge shaped members which are located on the medial side of the midline of the footbed for rotating the footbed about an axis parallel to the longitudinal axis of the footbed as the footbed is moved rearwardly relative to the underlying sole member. The rotational motion thus imparted to the footbed compensates for the natural rotational movement of a foot during normal running, walking, jogging, and the like.

BRIEF DESCRIPTION OF THE DRAWINGS

The above and other objects, features and advantages of the present invention will become apparent from the following detailed description of the accompanying drawings in which:

FIG. 4 is a side cross-sectional view of a ski boot showing the principal features of a preferred embodiment of the present invention.

FIG. 5 is a partial front elevation view of the principal features of FIG. 4.

FIG. 15 is a cross-sectional view of another embodiment of the present invention.

FIG. 16 is a cross-sectional view taken along lines 6—6 of FIG. 5.

FIG. 32 is a cross-sectional view of another embodiment of the present invention.

FIG. 33 is a cross-sectional view of another embodiment of the present invention.

FIG. 37 is a side elevation view of another embodiment of the present invention.

FIG. 38 is a transverse cross-sectional view of a pulley and cable assembly used in the embodiment of FIG. 37.

FIG. 39 is a longitudinal cross-sectional view of the assembly of FIG. 38.

DETAILED DESCRIPTION OF THE DRAWINGS

Figure 2:
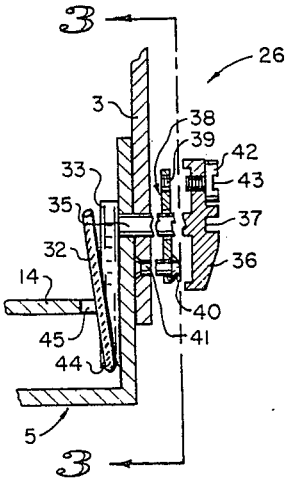
FIG. 2 is a partial cross-sectional view taken in the direction of lines 2—2 of FIG. 1.
Figure 3:
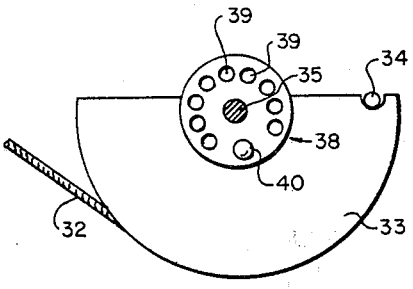
FIG. 3 is a partial side elevation view taken in the direction of lines 3—3 in FIG. 2.

Referring to FIGS. 1–5, there is provided, in accordance with the present invention, a ski boot designated generally as 1. In the ski boot 1 there is provided a lower shell member 2 and an upper cuff member 3. In the lower shell member 2 there is provided a sole member 5. The sole member 5 and the lower shell member 2 and upper cuff member 3 are relatively rigid and typically are made of plastic or similar material.

The upper cuff member 3 is provided with an extended portion forming a conventional front cuff flap 6 and a conventional single buckle assembly 7, as seen more clearly in FIGS. 4 and 5, for opening and closing the ski boot 1 and permitting the insertion and removal of a foot therefrom. Because of the fitting system of the present invention, and unlike conventional buckled ski boots, the ski boot 1, according to the present invention does not require buckles on the lower shell member 2, as will be apparent from the following description.

In the interior of the upper cuff member 3, and extending into the interior of the lower shell member 2 there is provided a liner designated generally as 10. In the liner 10 there is provided a forward section 11 and a rearward section 12. To facilitate entry and exit from the ski boot 1, the forward section 11 and rearward section 12 are separable along an intermediate line 13 extending from the top of the liner 10 down to approximately the ankle area and then forward to approximately the forward end of the longitudinal arch. The forward section 11 and rearward section 12 overlap along the line of separation to provide for adjustability of fit.

Figure 1:
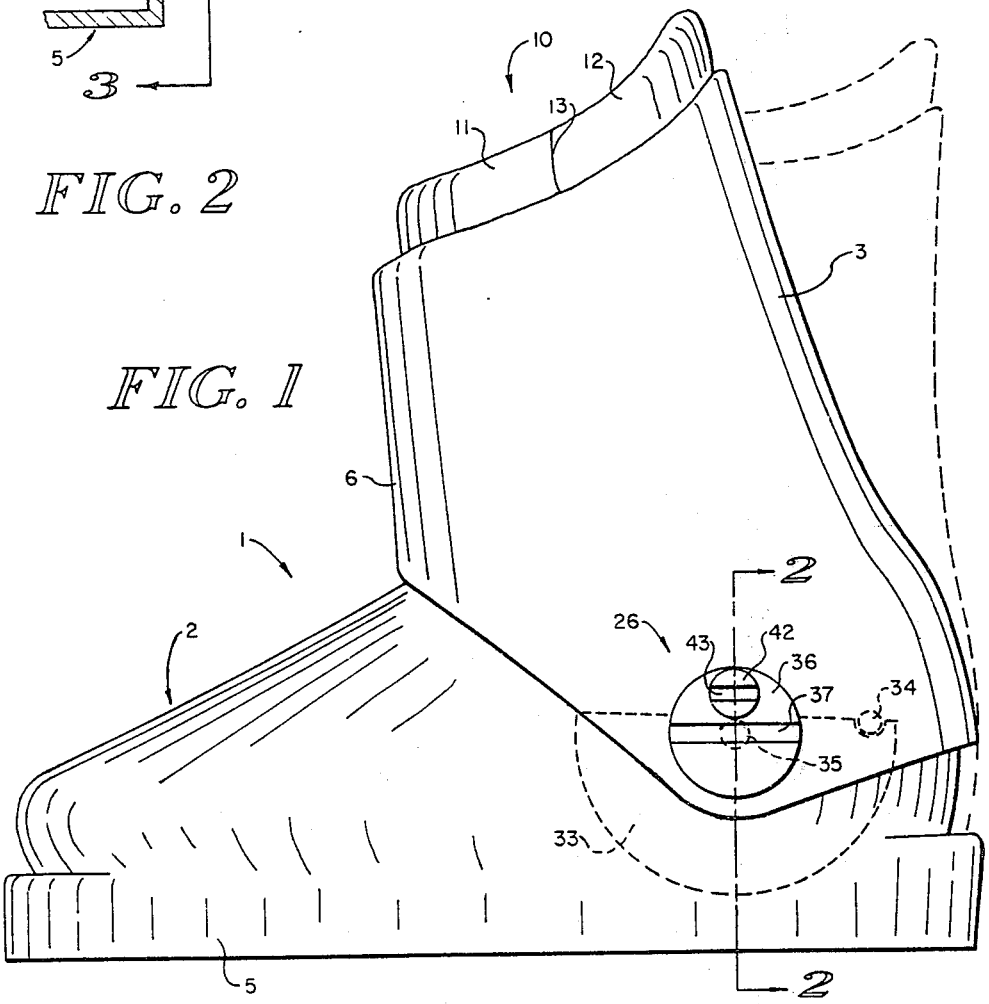
FIG. 1 is a side elevation view of a preferred embodiment of the present invention.

As seen in FIG. 1, the upper cuff member 3 is pivotally coupled to the lower shell member 2. It may move from a position as shown in broken lines in FIG. 1 to a position approximately twenty degrees forward of a vertical line extending through the pivot axis perpendicular to the plane of the sole member 5 of the lower shell member 2. The pivot axis, as will be apparent, is approximately at the position of an ankle of a foot in the ski boot 1.

In the interior of the ski boot 1, the upper surface of the sole member 5 forms a footbed 14 for supporting a skier's foot. In a first area provided for receiving the base of the toes of a skier's foot, there is pivotally attached to the footbed 14, as by a screw 16 or the like, a first strap member 17. Pivotally attached to a second area of the footbed 14, provided for receiving the base of the heel of a skier's foot, as by a screw 18 or the like, there is a second strap member 19. The strap members 17 and 19 extend from their respective areas of attachment to the footbed 14 around the lateral aspect and over the dorsum of the foot. Typically the strap members 17 and 19 pass between the liner 10 and the interior of the lower shell member 2. There may be optionally provided, between the strap members 17 and 19 and the liner 10, a relatively rigid tongue member 20. The tongue member 20 is provided for distributing the forces applied by the strap members 17 and 19 over the upper surface of the foot engaged thereby.

At their opposite ends, the strap members 17 and 19 are pivotally connected as by rivets 27 and 29 to an elongated pivotable linking member 30. The linking member 30 is pivotally connected, as by a rivet 31, intermediate the areas of connection of the strap members 17 and 19 to a cable 32. The opposite end of the cable 32 is connected to a pulley 33 in an adjusting mechanism designated generally as 26, as by a fitting 34.

As shown more clearly in FIG. 2, the pulley 33 terminates the end of a shaft 35. The shaft 35 is rotatably supported in a bore in the lower shell member 2 and upper cuff member 3 and functions as a pivot axis for the pivoting of the upper cuff member 3 relative to the lower shell member 2. A knob member 36 is connected to the exterior end of the shaft 35. In the center of the knob member 36 there is provided a slot 37 for receiving a screw driver, coin or the like (not shown) for rotating the knob member 36. Interior of the knob member 36 there is a locking plate member 38. In the locking plate member 38 there is provided a plurality of locking holes 29, as seen more clearly in FIG. 3. The locking plate member 38 is fixedly attached to the upper cuff member 3, as by a rivet 40 permanently inserted in a hole 41 provided therefor in the upper cuff member 3, as seen more clearly in FIG. 2. For releasably coupling the knob member 36, shaft 35 and pulley 33 to the upper cuff member 3, there is, for engaging one of the plurality of locking holes 39, a set screw member 42 or the like threadably inserted in the knob member 36. In the set screw member 42 there is provided a slot 43 for receiving a screw driver, coin or the like (not shown) for turning the set screw member 42 in opposite directions for engaging and disengaging the set screw member 42 from one of the locking holes 39. For guiding the cable 32 around the periphery of the pulley 33 there is provided a groove 44 in the periphery of the pulley 33. As seen in FIG. 2, a clearance slot 45 is provided for the lower portion of the pulley 33 and the cable 32 in the footbed 14 of the sole member 5.

Typically, the knob member 36 is approximately one and one half inches in diameter and the pulley 33 is approximately three inches in diameter. The strap members 17 and 19 may be made of leather or synthetic material. The linking member 30 is approximately two inches in length between the rivets 27 and 29, and is located on the superior medial aspect of the longitudinal arch forward of the medial malleolus. The rivet 31 for connecting the cable 32 to the linking member 30 is located approximately three quarters of an inch forward of the rivet 29. Preferably, the lower end of the strap member 17 is pivotally attached to the footbed 14 at the forward end of the longitudinal arch under the distal lateral metatarsal heads and passes around the lateral aspect of the forefoot and over the dorsum of the foot. The lower end of the strap member 19 is pivotally attached to the footbed 14 at the rearward end of the longitudinal arch, under the base of the calcaneous, passes around the lateral aspect of the heel forward of the lateral malleolus and over the instep. The liner 10 generally comprises a molded closed-cell urethane.

In use, the single buckle assembly 7 is pivoted outwardly, releasing the single buckle assembly 7 from the front cuff flap 6 allowing the front cuff flap 6 to open in a conventional manner. The upper cuff member 3 may then be pivoted rearwardly about the shaft 35 until the lower rear edge of the upper cuff member 3 is stopped by the upper rear edge of the sole member 5, as shown in broken lines in FIG. 1. The liner rearward section 12 overlying the posterior aspect of the calf is then pivoted in a clockwise or rearward direction, allowing the foot to enter the boot. Alternatively, the liner rearward section 12 may be secured to and pivot with the upper cuff member 3.

When the upper cuff member 3 is pivoted rearwardly, the pulley 33 also rotates clockwise, resulting in a relative lengthening of the cable 32 and a loosening of the forward strap member 17 and rearward strap member 19. The loosening of the strap members 17 and 19 permits the insertion of a foot into the ski boot. When the foot is in the boot, the upper cuff member 3 is pivoted forwardly or counterclockwise and the front cuff flap 6 closed by engaging the single buckle assembly 7. When the front cuff flap 6 is secured by the single buckle assembly 7, the upper cuff member 3 may pivot forwardly approximately an additional twenty degrees, but is prevented from pivoting rearwardly by the overlap of the front cuff flap 6 on the lower shell member 2.

When the upper cuff member 3 is pivoted forwardly, the pulley 33 rotates counterclockwise, resulting in a relative shortening of the cable 32 and a tightening of the forward strap member 17 and rearward strap member 19. As the strap members 17 and 19 are tightened, the linking member 30 moves and pivots about the rivet 31 resulting in relative equalization of the pressure of the forward strap member 17 and rearward strap member 19 against the foot engaged thereby.

Once the foot is in the ski boot, the initial fit, and indeed any subsequent fit, is easily adjusted from outside of the boot. This is accomplished by disengaging the set screw member 42 from one of the locking holes 39 in which it is engaged and rotating the knob member 36 as by placing a coin or the like in the slot 37 to position the set screw member 42 in another one of the locking holes 39.

For example, by rotating the knob member 36 clockwise, the strap members 17 and 19 are loosened for a given relative position of the upper cuff member 3 and lower shell member 2. Similarly, by rotating the knob member 36 counterclockwise, the strap members 17 and 19 are tightened for a given relative position of the upper cuff member 3 and lower shell member 2. Thus, once the position of the strap members 17 and 19 is adjusted as desired, the set screw member 42 may be turned for engaging the set screw member 42 in one of the appropriate locking holes 39 for locking the pulley 33 to the upper cuff member 3. A torque wrench with a predetermined setting may be conveniently used to adjust the fitting system in the ski shop.

While conventional ski boots have an essentially static fit, the fitting system of the present invention as described herein changes size and shape dynamically in response to the various maneuvers in skiing. With conventional boots during a turn, forward bending at the ankle with a tendency for hindfoot upward movement and forefoot sideways movement usually occurs when downward and sideways force is applied to the leading edges of the skis. Rearward bending at the ankle with a tendency for forefoot upward and sideways movement usually occurs when the ski tips are raised. This is because a slight looseness in the fit is ordinarily provided for comfort and adequate circulation to prevent coldness, fatigue, and pain. With the present invention, maximum restraint of upward, forward, rearward, and sideways movement of the foot is provided, while also providing the maximum transmission of energy between the foot and the release binding. This is accomplished with the fitting system of the present invention in two ways. Firstly, any hindfoot upward movement that occurs tightens the forward strap member 17 by causing a counterclockwise rotating of the linking member 30 about the rivet 31, thereby minimizing any forefoot instability and maximizing energy transmission. Likewise, any forefoot upward movement tightens the rearward strap member 19. Secondly, forward bending at the ankle causes the upper cuff member 3 to pivot forwardly relative to the lower shell member 2 with consequent counterclockwise rotation of the pulley 33, thereby relatively shortening the cable 32, tightening the forward strap member 17 and rearward strap member 19 and reducing the size of the interior of the liner 10.

If desired, the strap members 17 and 19 may be made slightly elastic or a spring connected between the cable 32 and the linking member 30 for shock absorption. Dead air space insulation is inherent in the fitting system because the fit is not determined by contact between the shell and the foot.

Figure 7:
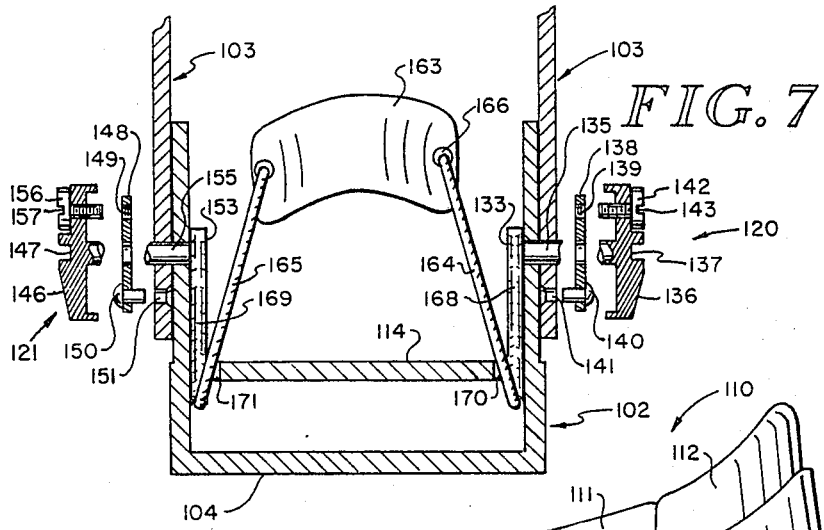
FIG. 7 is a partial cross-sectional view taken in the direction of lines 7—7 of FIG. 6.
Figure 6:
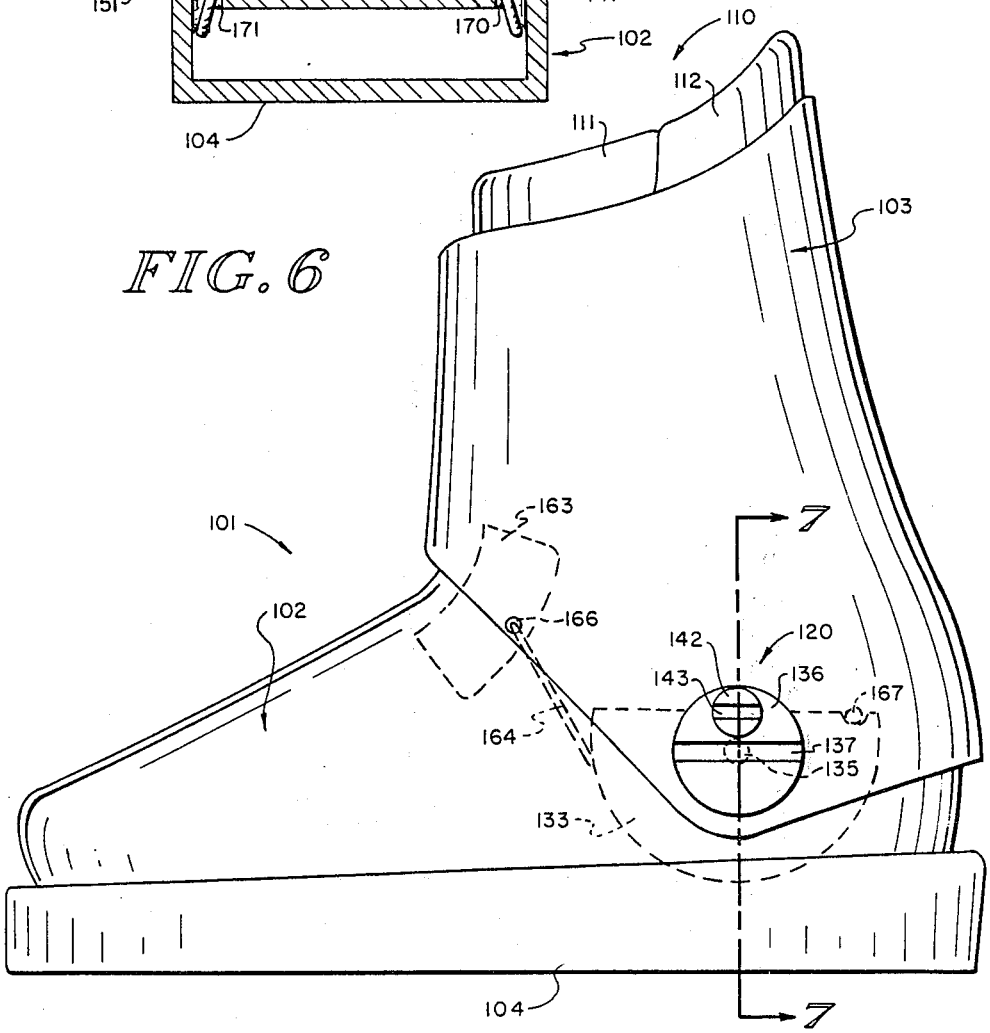
FIG. 6 is a side elevation view of an alternative embodiment of the present invention.

Referring to FIGS. 6 and 7, there is provided in an alternative embodiment of the present invention, a ski boot designated generally as 101. Ski boot 101 is substantially identical to ski boot 1 of FIGS. 1–5 and comprises a lower shell member 102 and an upper cuff member 103. In the lower shell member 102 there is provided a sole member 104. The upper surface of the sole member 104 forms a footbed 114, as seen more clearly in FIG. 7. Interior of the lower shell member 102 and upper cuff member 103, there is a liner 110 having a forward section 111 and a rearward section 112, essentially identical to the liner 10 of FIGS. 1–5. Releasably coupled to the upper cuff member 103, there is a pair of adjusting mechanisms, designated generally as 120 and 121.

The adjusting mechanisms 120 and 121 are substantially identical. The adjusting mechanism 120 includes a pulley 133 which terminates the interior end of a shaft 135. Terminating the exterior end of the shaft 135 is a knob member 136. In the knob member 136 there is provided a slot 137 for receiving a screw driver, coin or the like for turning the knob member 136. Interior of the knob member 136 there is a locking plate member 138 with a plurality of locking holes 139. Opposite the locking holes 139 there is provided a rivet 140 or the like for fixedly attaching the locking plate member 138 permanently in a hole 141 provided therefor in the upper cuff member 103. For releasably coupling the knob member 136 to the locking plate member 138, there is a set screw member 142. In the set screw member 142 there is provided a slot 143 for receiving a screw driver, coin or the like for turning the set screw member 142. The set screw member 142 is provided for releasably engaging one of the locking holes 139 in the locking plate member 138. As thus described, the adjusting mechanism 120 is substantially identical to the adjusting mechanism 26 described above with respect to the embodiments of FIGS. 1–3.

On the opposite side of the ski boot the adjusting mechanism 121 is releasably coupled to the upper cuff member 103 in the same manner as the adjusting mechanism 120 and, except for the reverse orientation of the parts, comprises each of the parts described above with respect to the adjusting mechanism 120. Accordingly, there is provided in the adjusting mechanism 121 a knob member 146 having a slot 147 for turning the knob member 146, a locking plate member 148 with a plurality of locking holes 149, an interior pulley 153 terminating the end of a shaft 155, and a rivet 150 for attaching the locking plate member 148 in a hole 151 provided therefor in the upper cuff member 103. For releasably coupling the knob member 146 to the upper cuff member 103, there is also provided a set screw member 156. In the set screw member 156 there is provided a slot 157. The slot 157 is provided for receiving a screw driver, coin or the like for turning the set screw member 156 into and out of engagement with one of the locking holes 149.

In the interior of the lower shell member 102 and upper cuff member 103 there is a tongue member 163. The tongue member 163 extends from above the ankle to the forefoot and is provided for engaging the upper surface of a skier's foot in the area of the instep. It is connected to the pulleys 133 and 153 by means of a pair of cables 164 and 165, respectively. The cables 164 and 165 are connected to the tongue member 163 at opposite lateral edges as by a pivotable rivet 166, and to the pulleys 133 and 153 by means of a fitting 167, as seen more clearly in FIG. 6. As in the pulley 33 of the embodiment of FIGS. 1–5 the pulleys 133 and 153 are also provided with grooves 168 and 169, respectively, for guiding the cables 164 and 165. For providing clearance for the lower portion of the pulleys 133 and 153, there is provided in the footbed 114 of the sole member 104, a pair of clearance slots 170 and 171, respectively.

In use, each of the adjusting mechanisms 120 and 121 can be adjusted separately and individually for positioning the tongue member 163 on the upper surface of the foot and for applying the desired amount of tension to the tongue member 163 relative to the lower extremity engaged thereby for any given relative position of the upper cuff member 103 and lower shell member 102. This is accomplished by disengaging the set screw member 142 from one of the locking holes 139 in which it is engaged. Once the set screw member 142 is disengaged from one of the locking holes 139, the knob member 136 can be rotated by a screw driver, coin or the like placed in the slot 137. As the knob member 136 is rotated, the length of cable wrapped around the pulley 133 will be increased or decreased. The same procedure is used for adjusting the length of cable wrapped around the pulley 153 of the adjusting mechanism 121. After the desired tension is applied to the tongue member 163, the set screw members 142 and 156 are again turned for engaging their respective locking holes for coupling the knob members 136 and 146 to the upper cuff member 103.

After the knob members 136 and 146 are coupled to the upper cuff member 103, any pivotal movement of the cuff member 103 relative to the lower shell member 102 will result in dynamic adjustment of the tightening applied to and position of the tongue member 163 relative to the foot. Thus, as the upper cuff member 103 is pivoted forwardly relative to the lower shell member 102, the tension on the cables 164 and 165 is increased, pulling the tongue member 163 into tighter engagement with the foot. Conversely, when the upper cuff member 103 is pivoted rearwardly, the tension is reduced on the cables 164 and 165 and the tongue member 163 loosens relative to the foot.

Figure 9:
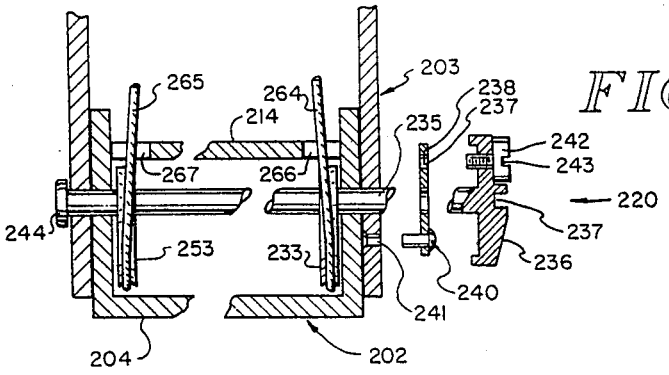
FIG. 9 is a partial cross-sectional view taken in the direction of lines 9—9 of FIG. 8.
Figure 8:
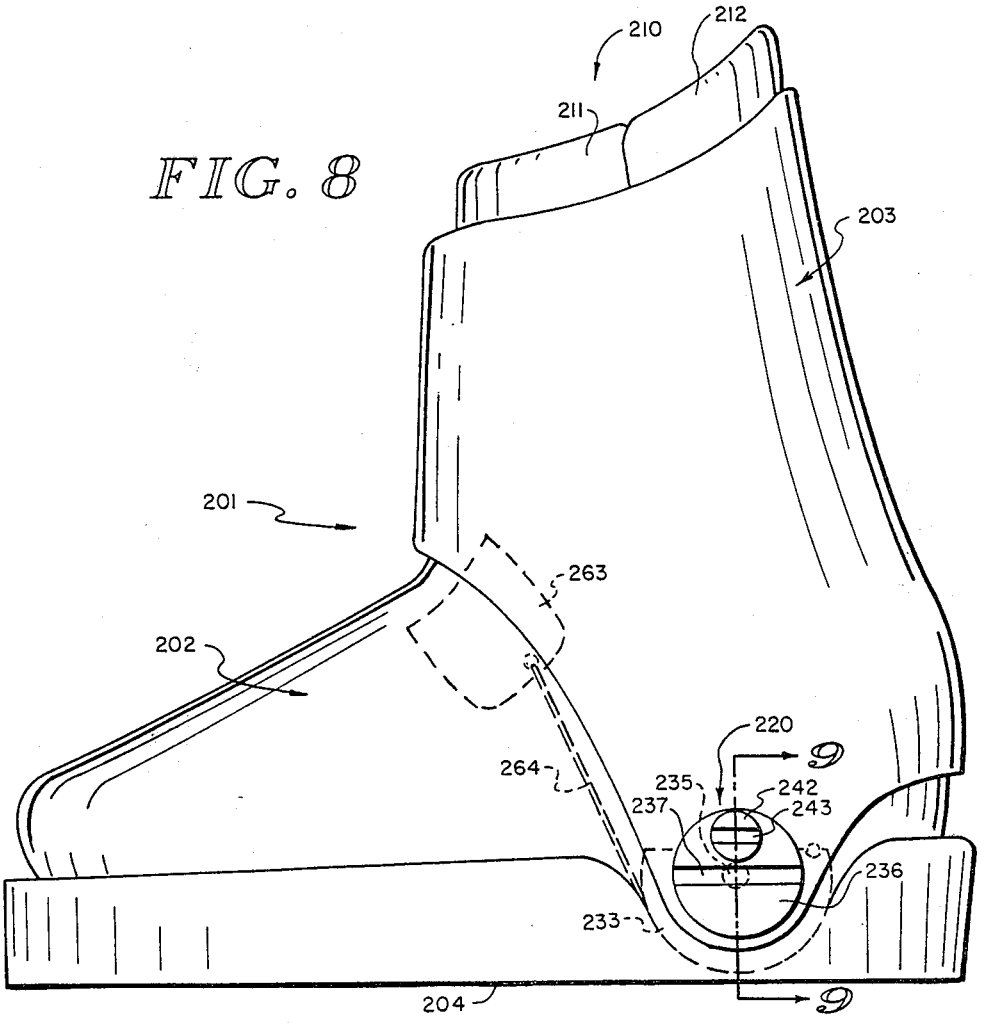
FIG. 8 is a side elevation view of still another embodiment of the present invention.

Referring to FIGS. 8 and 9, there is provided in another embodiment of the present invention a ski boot 201 having a lower shell member 202, an upper cuff member 203, a sole member 204 and a liner 210 comprising a forward section 211 and a rearward section 212. Releasably coupled to the upper cuff member 203 there is an adjusting mechanism 220. The adjusting mechanism 220 includes a knob member 236. Interior of the knob member 236 there is a locking plate member 238. In the locking plate member 238 there is provided a plurality of locking holes 239 for engaging a set screw member 242 provided therefor in the knob member 236. In the set screw member 242 there is provided a slot 243 for receiving a screw driver, coin or the like for turning the set screw member 242 into and out of engagement with the locking holes 239. In the locking plate member 238 there is also a rivet 249 or the like for permanently fixedly attaching the locking plate member 238 in a hole 241 provided therefor in the upper cuff member 203.

The knob member 236 terminates an exterior end of a shaft 235. The shaft 235 extends transversely through the sole member 204 beneath an interior footbed 214 located in the interior of the lower shell member 202. Connected to the shaft 235 adjacent to respective interior wall surfaces of the sole member 204 there is a pair of spaced pulleys 233 and 253. The shaft 235 includes a flange butt 244 for preventing the upper cuff member 203 from slipping laterally from the shaft 235. The pulleys 233 and 253 are connected to a tongue member 263 as by a pair of cables 264 and 265. Located adjacent to the pulleys 233 and 253 there is provided in the footbed 214 a pair of clearance slots 266 and 267. The slots 266 and 267 are provided for the pulleys 233 and 253.

The adjusting mechanism 220 of the embodiment of FIGS. 8 and 9 is adjusted in the same manner as the mechanism described above with respect to FIGS. 6 and 7. The principal difference is the location of the pulleys 233 and 253 relative to the position of the pulleys 133 and 153 of FIGS. 6 and 7. In the embodiment of FIGS. 8 and 9, the axis of rotation of the pulleys 233 and 253 is placed below the plane of the footbed 214. By placing the axis of rotation of the pulleys 233 and 253 below the plane of the footbed 214, both of the pulleys 233 and 253 may be connected to the common shaft 235 and the single knob member 236 employed for adjusting the mechanism 220.

As seen more clearly in FIG. 8, in order to use the common shaft 235 for connecting the pulleys 233 and 253, and retain the dynamic adjusting feature of the previous embodiments, it is necessary to extend the lower portion of the upper cuff member 203 below the plane of the footbed 214 and to provide a clearance slot for the rotation thereof in the sole member 204. As is apparent, the lower placement of the adjusting mechanism 220 permits the elimination of one of the adjusting knob members from the exterior of the boot, thereby simplifying the construction and reducing the number of parts required therefor.

Figure 12:
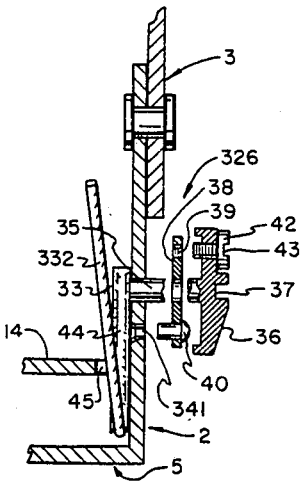
FIG. 12 is a partial cross-sectional view taken in the direction of lines 12—12 of FIG. 11.
Figure 10:
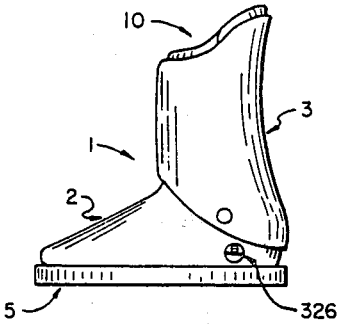
FIG. 10 is a side elevation view of still another embodiment of the present invention.
Figure 11:
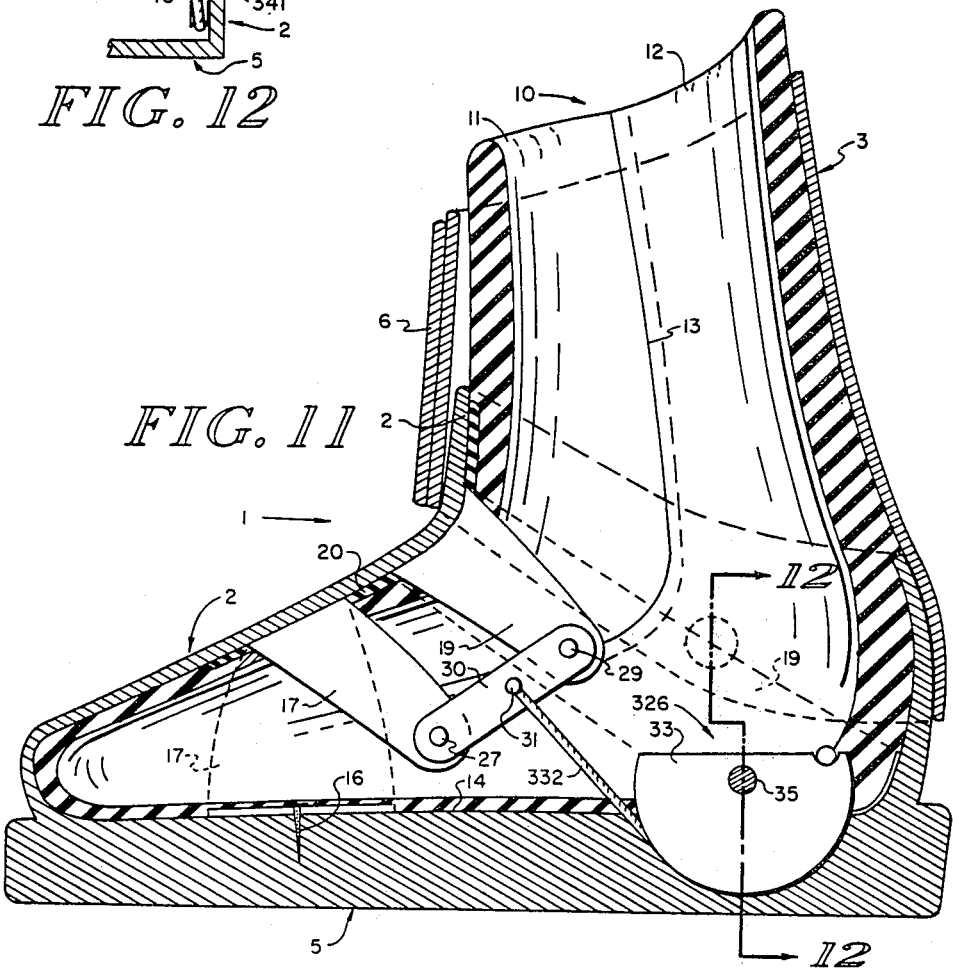
FIG. 11 is a side cross-sectional view showing the principal features of FIG. 10.

Referring to FIGS. 10–12, in another embodiment of the present invention, the strap members 17 and 19 and the linking member 30 of the embodiment of FIGS. 1–5 are coupled to one end of a tightening member such as a cable or the like 332. The opposite end of the cable 332 is connected to an adjusting mechanism designated generally 326. The cable 332 and the adjusting mechanism 326 are substantially identical to the cable 32 and the adjusting mechanism 26 of the embodiment of FIGS. 1–5. The principal differences lie in the position of the cable 332 and the adjusting mechanism 326 relative to the upper cuff member 3.

In the embodiment of FIGS. 10–12, the adjusting mechanism 326 is coupled to the lower shell member 2 of the ski boot below the lower boundary of the upper cuff member 3. The adjusting mechanism 326 is fixedly attached thereto by a rivet 40 in a hole 341 provided therefor in the lower shell member 2 of the ski boot 1.

In use, the skier adjusts the amount of tension applied to the strap members 17 and 19 by rotating the adjusting assembly 326 as described above with respect to the adjusting mechanism 26 of the embodiment of FIGS. 1–5. Since the adjusting mechanism 326 is coupled to the lower shell member 2 instead of the upper cuff member 3, any forward or rearward pivoting of the upper cuff member 3 relative to the lower shell member 2 does not affect the amount of tension applied to the cable 322. However, any tendency for hindfoot or forefoot lift will cause a movement of the strap members 17 and 19 and linking member 30 such that a redistribution of the forces involved will occur. The forces on the strap members 17 and 19 will increase the amount of tension applied to the forward strap member 17 when heel lifting movement tends to occur and increase the amount of force applied to the rearward strap member 19 when forefoot lifting movement tends to occur.

Figure 14:
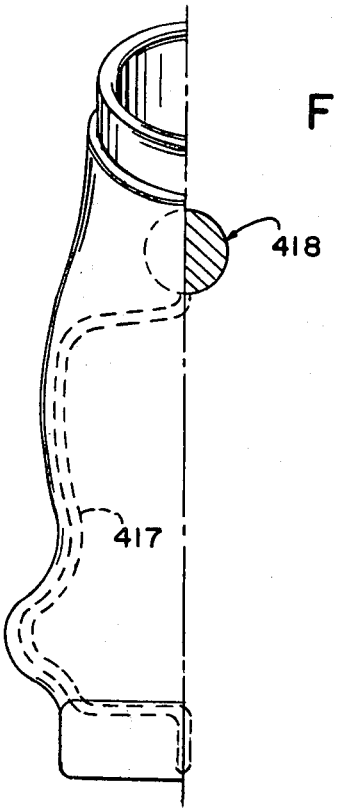
FIG. 14 is a partial front elevation view of FIG. 13.
Figure 13:
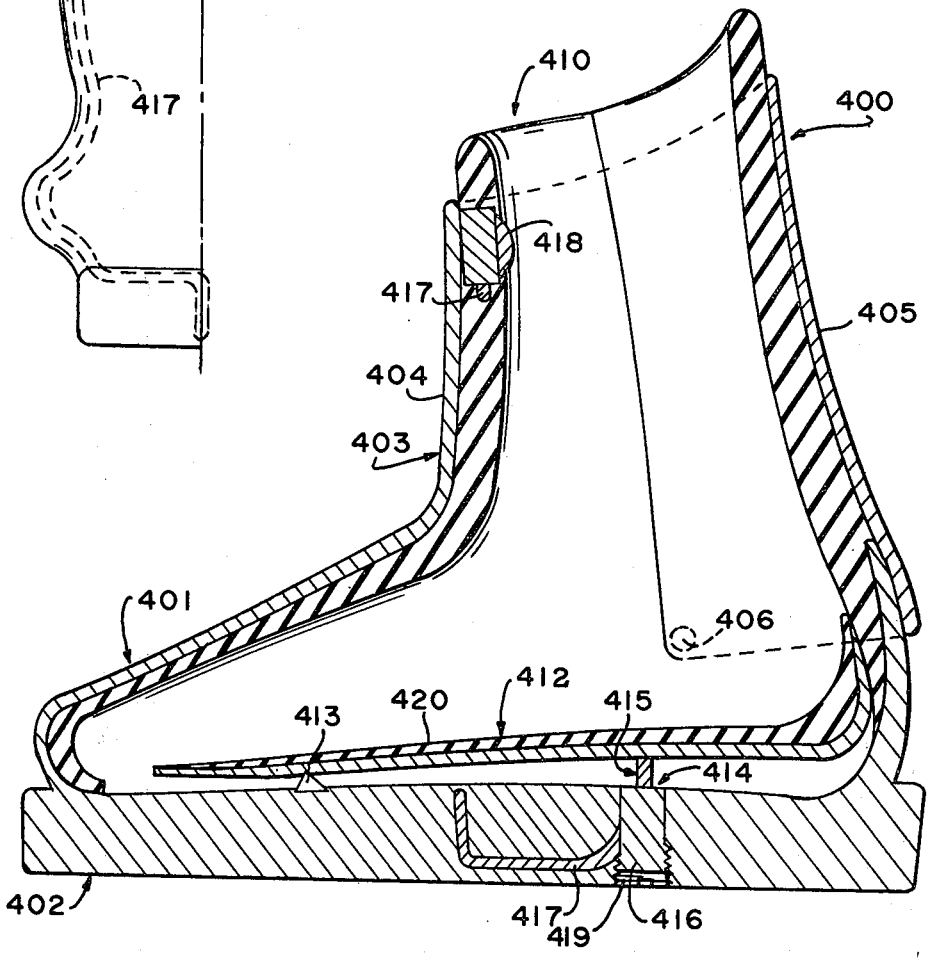
FIG. 13 is a cross-sectional view of another embodiment of the present invention.
Figure 17:
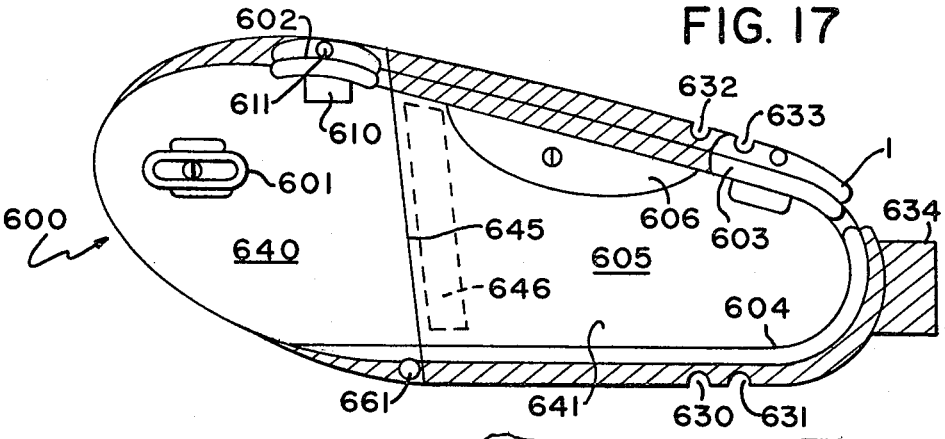
FIG. 17 is a plan view of still another embodiment of the present invention.
Figure 18:
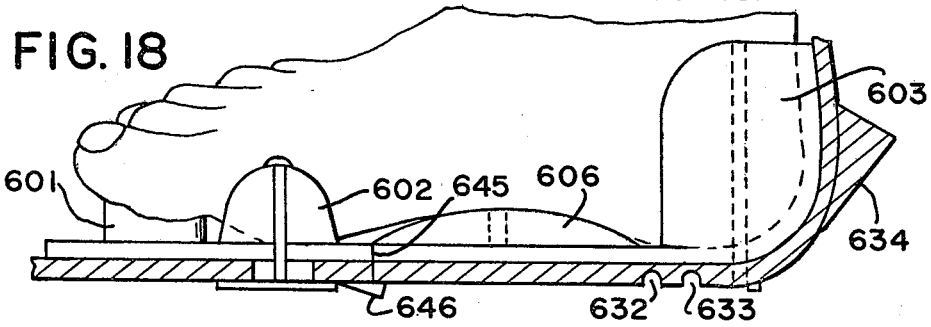
FIG. 18 is an interior or medial view of the embodiment of FIG. 7.
Figure 19:
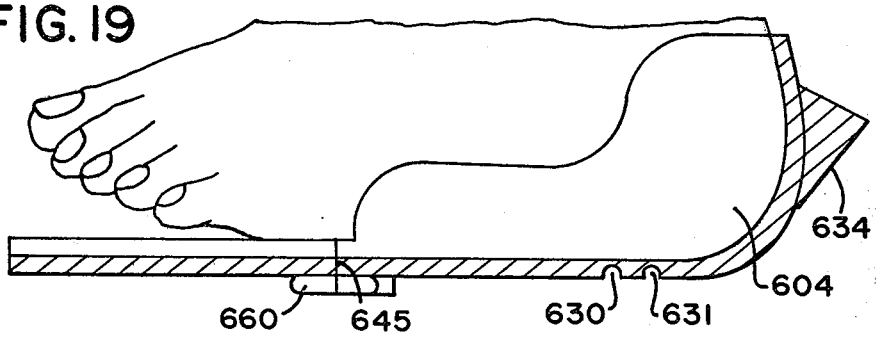
FIG. 19 is an outside or lateral view of the embodiment of FIG. 7.
Figure 20:
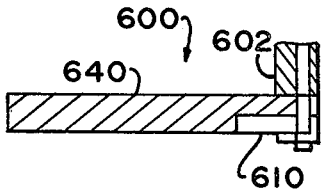
FIG. 20 is a cross-sectional view taken in the direction of the lines 10—10 of FIG. 17.

Referring to FIGS. 13 and 14 there is provided, in accordance with another embodiment of the present invention a sport shoe comprising a ski boot designated generally as 400. In the ski boot 400 there is provided a lower shell member 401 comprising a sole member 402. Extending from the upper end of the shell member 401 there is provided a cuff member 403. The cuff member 403 comprises a forward rigid section 404 and a movable rearward section 405. The rearward section 405 is pivotally attached to the shell member 401 by means of a rivet or the like 406. The rivet 406 is located in the vicinity of the ankle. The rearward section 405 is attached to the forward section 404 by means of a buckle or the like (not shown) in a conventional manner.

In the interior of the boot 400 there is provided a relatively soft resilient liner 410. The liner 410 provides warmth and comfort.

Located in the bottom of the boot 400 and supported on the sole 402 there is provided a movable footbed 412. The footbed 412 is pivotally supported at its forward end by an unequal sided triangular pivot member 413 for adjusting the height of the front end of the footbed. At its rear end the movable footbed 412 is supported on a movable piston assembly 414. The piston assembly 414 is provided with a close fit height adjustment screw 419 and a piston 415 which is movably mounted in a cylinder 416. The cyinder 416 is coupled by means of a hydraulic line 417 to a transducer 418 which is mounted along the forward upper midline of the cuff member 404. The hydraulic line 417 extends between the transducer 418 and the cylinder 416.

On its upper surface the footbed 412 is provided with a liner 420 for providing warmth and comfort. The fluid line 417 is typically routed between the cuff member 404 and shell member 401 and the liner 410 and between the transducer 418 and the fluid cylinder 416.

To enter the ski boot 400 the rear cuff member 405 is released from the forward cuff member 404 and moved rearwardly. After the rear cuff member 405 is moved rearwardly and the boot is opened, the skier inserts his foot in the boot and onto the footbed 412. After the skier's foot is in the boot and supported on the footbed 412 the rear cuff member 405 is adjusted and closed to the forward cuff member 404 providing a close fit and preventing a loosening from the close fit position. Thereafter movement of the skier against the transducer 418 will cause a change in the pressure in the line 417 resulting in an adjustment in the height of the footbed 412. Thus with forward lean, as during a turning maneuver, the footbed is raised momentarily thus tightening momentarily the fit of the ski boot relative to a foot enclosed thereby.

Instead of a hydraulic transducer and movable piston assembly as described above, an electrical transducer and piston assembly or the like may also be employed for moving the footbed 412 in response to wearer movement.

Referring to FIGS. 15 and 16 there is provided in another embodiment of the present invention a ski boot designated generally as 500. In the ski boot 500 there is provided a movable cuff member 501 and a lower shell member 502 extending from a sole member 514. The cuff member 501 is pivotally connected to the lower shell member 502 by means of a rivet or the like 509 as described above with respect to FIGS. 10–14. Interior of the cuff and shell members 501 and 502 there is provided a movable footbed 503 supported on the sole member 514. At its rear end the movable footbed 503 is attached to the cuff member 501 by means of a cable 504 which is hooked to a manual adjusting lever 510. The lever 510 is provided with a plurality of cable receiving slots 511 for providing selected cable adjustments. At its forward end, the movable footbed 503 is provided with a downwardly extending wedge shaped member 505. Immediately below the wedge shaped member 505 and extending upwardly from the sole 514 of the shell member 502, there is provided a corresponding wedge shaped member 506. The members 505 and 506 have facing surfaces which slope upwardly and forwardly, with the member 505 being located on the medial side of the longitudinal axis of the footbed 503 as seen in FIG. 16. Extending rearwardly from the footbed 503 there is provided a wedge shaped member 507. Adjacent to the member 507 and extending inwardly from the shell member 502 there is provided a corresponding wedge shaped member 508. Both members 507 and 508 are provided with upwardly and forwardly inclined facing surfaces.

In use, as a skier leans forward pivoting the cuff member 501 forwardly relative to the shell member 502, the rear end of the footbed 503 is lifted by the cable 504. As the footbed 503 is lifted by the cable 504, the wedge shaped members 507 and 508 with the upwardly and forwardly sloping facing surfaces force the footbed 503 to move forwardly relative to the sole member 514 as shown by the broken lines 516 and 517. As the footbed 503 is forced to move forwardly and upwardly relative to the sole member 514, the wedge shaped members 505 and 506 cause the forward end of the footbed 503 to move upwardly and to rotate about an axis parallel to the longitudinal axis of the sport shoe 500 toward the outer or lateral edge thereof as shown more clearly in FIG. 16 by the arrow 515. This rotation of the footbed 503 compensates for the tendency toward inward rotation of the leg and ski boot when the lower extremity is flexed forwardly during a turn.

Referring to FIGS. 17–25, there is provided in another embodiment of the present invention a movable footbed designated generally as 600 for use in a ski boot such as the boot 500 of FIG. 15. In the movable footbed 600 there is provided an adjustable toe member 601, an adjustable forefoot member 602, an adjustable heel member 603 and a fixed heel and sidewall member 604 extending upwardly from an interior sole member 605. To adust the forefoot member 602, the member 602 is mounted in a slot 610, with a bolt 611 and a retaining plate 612. Liner material 613 is provided on the interior surfaces for comfort. The other adjustable members are similarly constructed.

The toe member 601 is provided for being placed between the large and second toe. The forefoot member 602 is provided for engaging the medial edge of the ball of the foot. The heel member 603 is provided for engaging the medial edge of the heel. The fixed wall member 604 is provided for engaging the rear of the heel and the lateral edge of the foot. These footbed 600 adjustments compensate for the otherwise inward and outward rotation of the foot in the boot during a turn.

Located in a position to support the arch of a foot there is provided an adjustable arch support 606. Along the lateral and medial edges of the heel portion of the sole member 605 there is provided a plurality of recesses 630, 631, 632 and 633 for engaging a lifting cable (not shown). At the rear of the sole member 605 there is provided a wedging member 634.

The sole member 605 is divided into a forefoot bed 640 and a hindfoot bed 641 along the line designated 645. Rearward of the line 645 there is provided a wedging member 646. The wedging member 646 is provided for slidably engaging a corresponding member (not shown) extending upwardly from the interior surface of the sole of the boot shell as described above with respect to member 506 of FIG. 15.

Extending from the rear of the footbed 605 there is provided another wedging member 634. The member 634 performs the same function as the member 507 of FIG. 15. In contrast to the length and position of the wedging member 506 described above with respect to FIG. 15, the wedging member 646 and the corresponding wedging member extending from the interior surface of the sole of the boot shell extends across substantially the entire width of the forward end of the hindfoot bed 641.

In use, the members 601, 602, 603 and 606 are initially adjusted to fit a particular foot. Thereafter, a cable corresponding to cable 504 of the embodiment of FIG. 15 is fitted into one of the recesses 630–633. The recess chosen determines the amount the footbed will be raised for a given forward movement of the cuff member 501.

As described above with respect to the embodiment of FIGS. 15 and 16, as the cuff member 501 is rotated forwardly, the footbed 605 is raised causing the wedging member 634 and a wedging member corresponding to the member 508 of FIG. 15 to force the footbed 604 forwardly. As the footbed 605 is forced forwardly the wedging member 646 and the wedging member corresponding to the member 506 extending from the underlying boot shell forces the footbed 605 to move upwardly. Because the wedging member 646 extends substantially across the full width of the footbed 605, there is no tendency for rotational movement about a longitudinal axis parallel to the longitudinal axis of the sport shoe.

Figure 25:
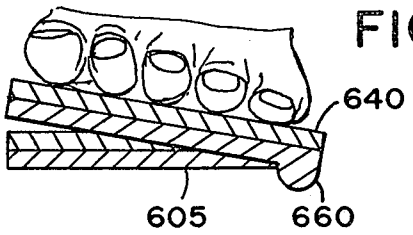
FIG. 25 is a transverse cross-sectional view of the embodiments of FIGS. 17–25 with the medial edge of the forefoot bed raised.

Referring to FIG. 25, while there is no tendency for rotational movement about a longitudinal axis parallel to the longitudinal axis of the sport shoe, it is understood that the wedging member 646 and/or the corresponding member extending from the interior surface of an underlying boot shell could be foreshortened to provide the rotational motion described above with respect to the embodiment of FIGS. 15 and 16 if such motion is desired in a particular application as shown in FIG. 25.

Figure 26:
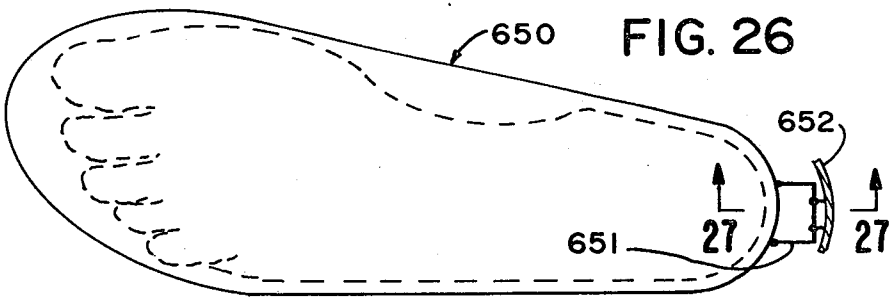
FIG. 26 is a plan view of still another embodiment of the present invention.
Figure 27:
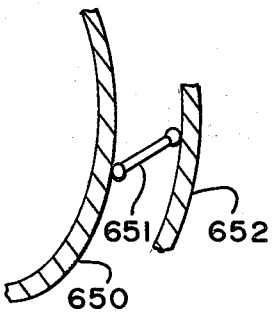
FIG. 27 is a partial cross-sectional view taken in the direction of an interconnected heel cup and heel wall in an alternative embodiment of the present invention.
Figure 21:
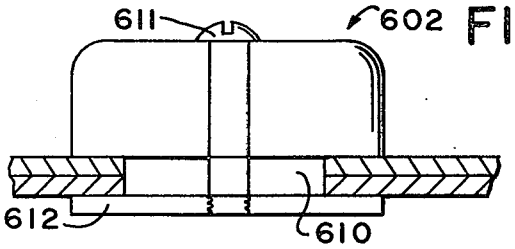
FIG. 21 is a side view of a forefoot adjustable wall according to the present invention.
Figure 22:
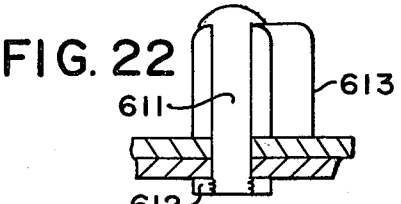
FIG. 22 is an end view of FIG. 21.
Figure 23:
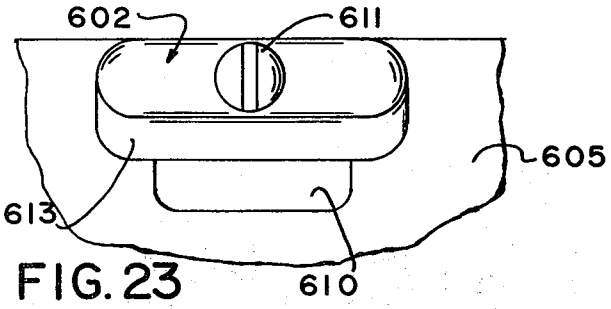
FIG. 23 is a top view of FIG. 21.

Referring to FIGS. 26 and 27, there is provided in another embodiment of the present invention a ski boot sole member designated generally as 650. At the rear end of the member 650 there is provided a rigid wire loop 651 movably coupled to a heel wall 652 of an exterior shell member. The loop 651 is provided to be used in place of the wedging member 634 described above with respect to the embodiment of FIGS. 17–19.

In use, as the heel of the sole member 650 is raised as by cables (not shown), the loop 651 moves the member 650 forwardly.

Figure 24:
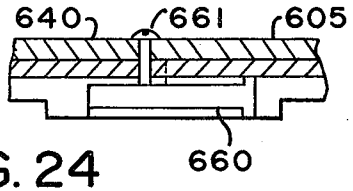
FIG. 24 is a partial cross-sectional view of a footbed pivot pin interconnecting the forefoot and hindfoot beds according to the present invention.
Figure 28:
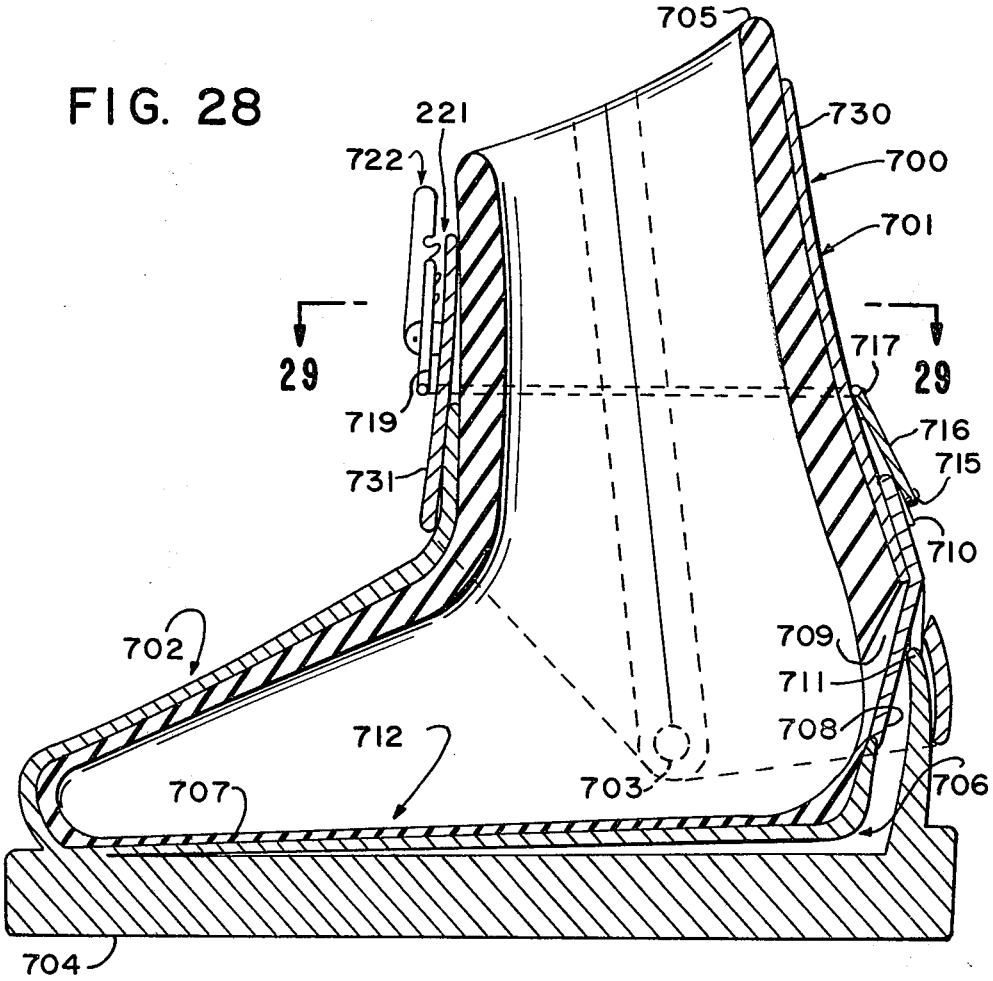
FIG. 28 is a cross-sectional view of another embodiment of the present invention.

Referring to FIGS. 24 and 25 the rearward and forward portions of the footbed 600 are movably held together by means of a pin 660 and a retaining screw 661. The retaining screw 661 engages the pin 660 to prevent the pin 660 from being removed from the cavity provided therefor in the footbed section 640.

With appropriate placements of wedge-shaped members or the like between the footbed 600 and an underlying sole member as described above with respect to the embodiment of FIGS. 15 and 16, the forward section 640 of the footbed 600 is rotatable about an axis parallel to longitudinal axis of the footbed for lifting the rear portion of the ball of the foot to compensate for natural foot rotation in forward leg flex during a turn as shown in FIG. 25.

Referring to FIGS. 28–31, there is provided in another embodiment of the present invention a ski boot designated generally as 700. In the ski boot 700 there is provided a movable cuff member 701 movably attached to a shell member 702 as by a rivet or the like 703. The shell member 702 includes a sole member 704.

In the interior of the cuff and shell members 701 and 702 there is provided a soft resilient liner 705. The liner 705 is provided for providing an initial close, warm, comfortable fit.

Located in the bottom of the shell 702 and supported on the sole member 704 there is provided a movable footbed member 712. The movable footbed member 712 is provided with a heel receiving portion 706.

The forward end of the footbed designated 707 is supported on the sole member 704. Attached to the rear end of the footbed 712 there is provided a cable 708. The cable 708 is routed upwardly through a hole 709 provided therefor in the liner 705 and cuff member 701. From the hole 709 the cable 708 is routed about a pulley 710 located on the exterior rear portion of the cuff member 701. In the pulley 710 the cable 708 is routed downwardly and attached at a point designated 711 to the sole 704.

Extending from the axis of the pulley 710 there is provided a pin member 715. Attached to the pin member 715 there is provided a cable 716. The cable 716 is routed from the pin 715 of the pulley 710 about a pair of rearward cable guide members 717 and 718. From the rearward guide members 717 and 718 the cable 716 is routed about a pair of forward guide members 719 and 720 through one of a plurality of cable receiving slots 721 of an overcenter buckle member 722. The overcenter buckle member 722 is provided to adjust the boot 700 to a close fit and to prevent loosening of the close fit during skiing.

Figure 29:
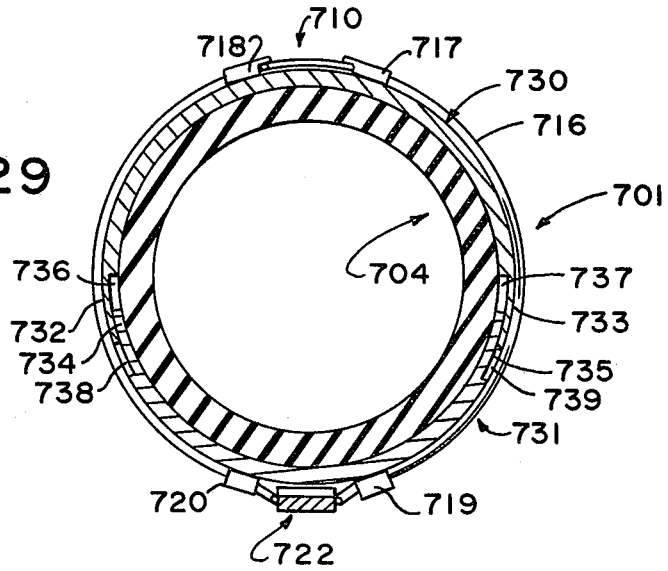
FIG. 29 is a cross-sectional view taken along lines 29—29 in FIG. 28.
Figure 30:
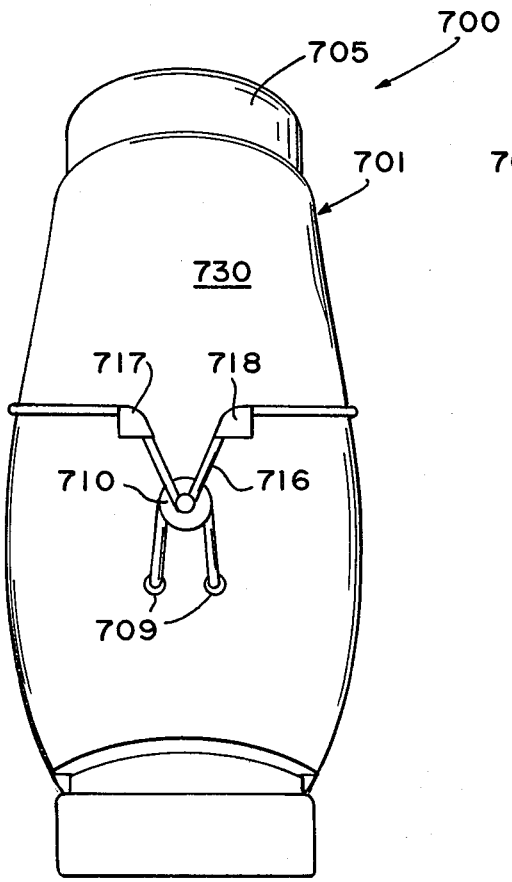
FIG. 30 is a rear elevation view of FIG. 28.
Figure 31:
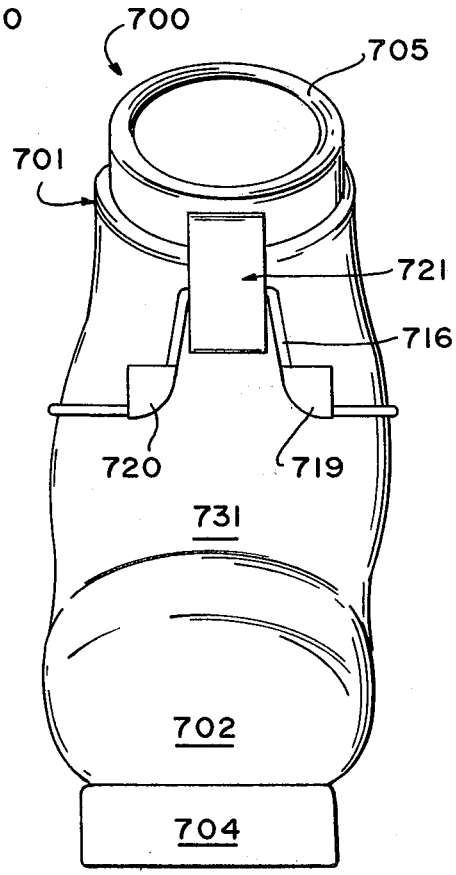
FIG. 31 is a front elevation view of FIG. 28.

Referring to FIG. 29 there is provided in the cuff member 701 a rearward cuff member 730 and a forward cuff member 731. The forward cuff member 731, when closed by the buckle 722 overlaps the upper end of the shell 702. The overlapping of the shell 702 by the cuff member 731 prevents the cuff member 731 from pivoting rearwardly during rearwardly leaning. Along its forward edges the rearward cuff member 730 is provided with a pair of flange members 732 and 733. Along its rearward edges the cuff member 731 is provided with a pair of corresponding flange members 734 and 735. The flange members 734 and 735 are provided to slideably move in and out of spaces 736 and 737 provided therefor interior of the flange members 732 and 733. Similarly the flange members 732 and 733 are provided to slidably move in and out of spaces 738 and 739 provided therefor on the exterior of the flange members 734 and 735.

In use during a forward lean as during a turning maneuver when a skier leans forwardly in his ski boots, the forward movement of the cuff member 701 relative to the shell member 702 increases the tension on the cable 708. As the tension on the cable 708 is increased, the rear end of the footbed 712 is raised from the sole member 704. As the rear end of the footbed 712 is raised from the sole member 704 tension is increased on the cable member 716 through the pulley 715. As the tension on the cable 716 is increased the cuff members 730 and 731 are drawn together. Thus, as the cuff members 730 and 731 are drawn together and the rear end of the footbed 712 is raised, the lower extremity is securely restrained from movement by momentary tightening in the boot 700.

Referring to FIG. 32 there is provided in another embodiment of the present invention a ski boot designated generally as 750. Except as described below, the ski boot 750 employs many of the same features of the ski boot 700 described above with respect to the embodiment of FIGS. 28–31. For convenience, those features are identified using the same numbers used in the description of the embodiment of FIGS. 28–31.

In the ski boot 750 the forward cuff member 731 is rigidly secured to the shell member 702 by means of a rivet or the like 752. In the upper forward portion of the cuff 731 there is provided a transducer 753. In a cavity 754 provided therefor in the sole of 704 there is provided a movable piston and motor assembly 755. In the movable piston and motor assembly 755 there is provided a pulley assembly 756, a motor and rack and pinion assembly 757, and a power source and control assembly 758. The assembly 755 is coupled to the transducer 753 by means of an electrical conductor 759. The conductor 759 is typically routed from the transducer 753 to the assembly 755 between the shell 702 and the liner 705.

Attached to the rear end of the movable footbed 712 there is provided a cable 760. The cable 760 is routed through the bore 709 provided therefor in the liner 705 and cuff member 701 and through the pulley 710. From the pulley 710 the cable 760 is routed through the bore 709 to the pulley assembly 756 controlled by the movable piston and motor assembly 755 in the sole 704 of the ski boot 750.

In use during a turning maneuver as a skier moves against the forward portions of the cuff member 701, pressure is increased on the transducer 753. As pressure increases on the transducer 753 a signal is generated which activates the movable piston and motor assembly 755 for winding the cable 760 about the pulley assembly 756. As the cable 760 is wound about the pulley assembly 756, tension is applied to the cable 760 raising the footbed 712 and drawing together the cuff members 730 and 731 of the cuff member 701 as described above with respect to the embodiment of FIGS. 28–31. Similarly when pressure is relieved from the transducer 753, the tightening on the cable 716 and 760 is relieved permitting the footbed 712 and the cuff members 730 and 731 to return to their initial position.

Figure 34:
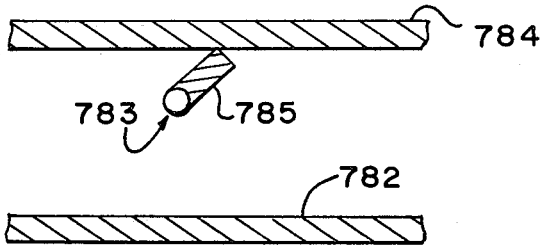
FIG. 34 is a cross-sectional view taken along lines 34—34 of FIG. 33.

Referring to FIGS. 33 and 34 there is provided a ski boot designated generally as 780. In the boot 780 there is provided a movable cuff member 781 and a shell member 782. The cuff member 781 is movably attached to the shell member 782 by means of a shaft 783. In the interior of the cuff and shell members 781 and 782 there is provided a movable footbed 784. Attached to the shaft 783 there is provided an elevation plate 785. At one end of the shaft 783 there is provided a plurality of teeth members 786. Mounted in a bore provided therefor in the cuff member 781 there is provided a corresponding set of teeth members 787. The teeth members 786 and 787 are provided for locking the shaft member 783 to the cuff member 781.

At the opposite end of the shaft member 781 there is provided an adjusting knob 788 and a spring member 789. Pivotally connected to the knob 788 there is provided a movable knob handle 790. The knob handle 790 may be provided outwardly for turning the knob 788.

In use as a skier leans forwardly in the boot 780, forward movement of the cuff member 781 rotates the rod 783 through the mating teeth members 786 and 787. As the rod 783 is rotated the elevation plate 785 contacts the movable footbed 784 raising the movable footbed. Conversely, rearward lean returns the movable footbed 784 to its initial position.

To provide for an initial adjustment of the position of the movable footbed 784 with the cuff member 781 in a given position relative to the shell member 782, the handle member 790 is grasped and rotated outwardly. As the handle 790 is in the proper position for adjusting the knob 788, the knob 788 is pushed inwardly against the force of the spring member 789. As the knob 788 is pushed inwardly against the spring member 789 the teeth 786 on the end of the shaft 783 are disengaged from the teeth 787 in the cuff 781. When the teeth 786 and 787 are disengaged, the shaft 783 is free to rotate independently of the cuff 781 to position the movable footbed 784 at any desired level within the available range of adjustments of the elevation plate 785.

Figure 36:
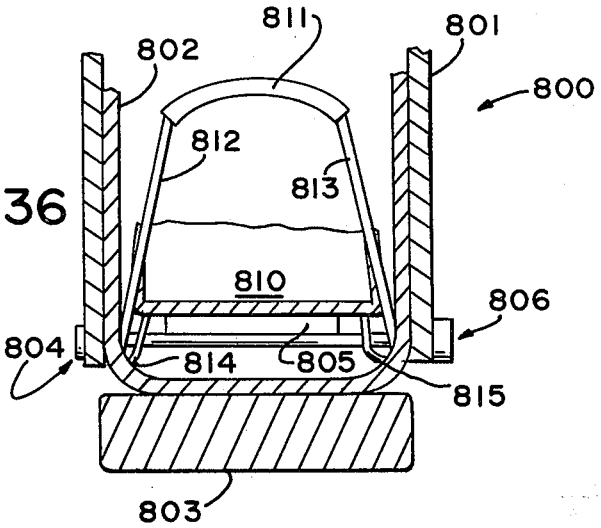
FIG. 36 is a partial cross-sectional view taken along lines 36—36 of FIG. 35.
Figure 35:
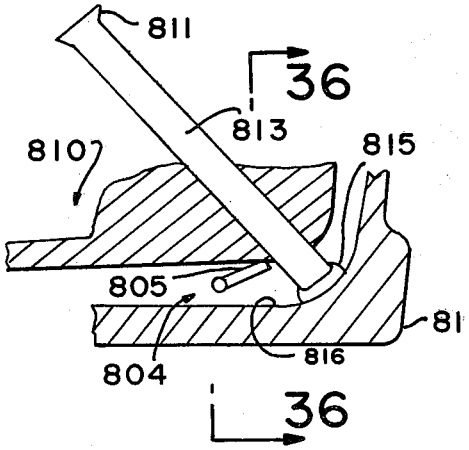
FIG. 35 is a partial cross-sectional side view of a strap interconnecting a heel cup and movable footbed assembly and boot shell according to another embodiment of the present invention.

Referring to FIGS. 35 and 36 there is provided in another embodiment of the present invention a ski boot designated generally as 800. In the boot 800 there is provided a movable cuff member 801 movably mounted to a shell 802 on a sole member 803. The cuff member 801 is coupled to the shell member 802 by means of a shaft assembly 804. In the shaft assembly 804 there is provided an elevation plate 805 and an adjusting knob assembly 806. The shaft assembly 804 is substantially identical to the shaft assembly 783 described above with respect to the embodiments of FIGS. 33 and 34.

In the inside of the boot 800 there is provided a movable footbed 810. Above the footbed 810 there is provided an instep engaging strap means 811. The strap means 811 is substantially identical to the member 163 described above with respect to the embodiment of FIGS. 6 and 7. Extending from the lateral edges of the strap member 811 there is provided a pair of strap members 812 and 813. The strap members 812 and 813 are routed through a pair of strap guides 814 and 815 mounted in the heel 816 of the sole 803 of the shell 802.

As described above with respect to the embodiment of FIGS. 33 and 34 and the embodiments of FIGS. 28–32, after the initial adjustment of the height of the footbed 810 using the adjusting knob 806, further movement of the footbed 810 is controlled by movement of the cuff member 801 relative to the shell member 802 as follows. During the turning maneuver when a skier leans forwardly in the boot 800 and moves the cuff member 801 forwardly relative to the shell member 802, the footbed 810 is raised. As the footbed 810 is raised, tension is applied to the strap members 812 and 813 pulling the instep engaging strap member 811 downwardly against the instep of a foot enclosed thereby. As the strap member 811 is pulled downwardly, a foot engaged thereby is restrained between the strap member 811 and the footbed 810 until forward pressure on the cuff member 801 is relieved.

Referring to FIGS. 37–39, there is provided in another embodiment of the present invention a ski boot designated generally as 850. In the ski boot 850 there is provided a movable cuff member 851. The cuff member 851 is movably coupled to a shell member 852 mounted on a sole member 853 by means of a shaft and pulley assembly 854. The shaft and pulley assembly 854 is mounted in a cavity 855 provided therefor in the sole 853. The upper wall or ceiling of the cavity 855 comprises a footbed 856.

Above the footbed 856 there is provided an instep tongue member 860 and a heel tongue member 861.

In the pulley and shaft assembly 854 there is provided a shaft member 865. Mounted to the shaft member 865 along the lateral edges of the footbed 856 there is provided a pair of pulley members 866 and 867. Coupling the heel tongue member 861 to the pulley members 866 and 867 there is provided a pair of cable members 868 and 869. Coupling the instep tongue member 860 to the pulley members 866 and 867 there is provided another set of cable members 870 and 871.

Between the pulley members 866 and 867 there is provided a gear 875. The gear 875 is provided for coupling the shaft 865 to a movable piston and motor assembly 876.

Mounted in the footbed 856 for contacting the ball of a foot there is provided a transducer assembly 877. The transducer assembly 877 is coupled to the piston and motor assembly 876 by means of a conductive line 878.

At one end of the shaft 865 of the shaft and pulley assembly 854 there is provided an adjusting knob assembly 880. In the assembly 880 there is provided an adjusting knob handle 881 and a spring member 882.

To initially adjust the position of the instep tongue member 860 and the heel tongue member 861 the knob handle 881 is pulled outwardly as described above with respect to the handle 790 of the embodiment of FIGS. 33 and 34. After the handle 881 is pulled outwardly the knob 880 is pushed inwardly, disengaging the teeth of the gear 875 from the piston 883 of the movable piston and motor assembly 876. With the gears 875 and the piston 883 disengaged the knob 880 is free to rotate the shaft 865 for adjusting the position of the instep tongue member 860 and the heel tongue member 861 for providing an initial close comfortable fit. Thereafter the gear 875 and the piston 883 are again engaged by releasing the knob to move outwardly under the force of the spring 882.

During skiing, pressure on the transducer and power supply and control assembly 877 moves the piston 883 of the movable piston and motor assembly 876 rotating the shaft 865. When the shaft 865 is rotated, the cables 868, 869, 870 and 871 are wound about the pulleys 866 and 867. As the cables 868–871 are wound about the pulleys 866 and 867, the instep tongue member 860 is drawn downwardly and the heel tongue member 861 is drawn forwardly for tightening momentarily the fit in the boot 850.

Figure 41:
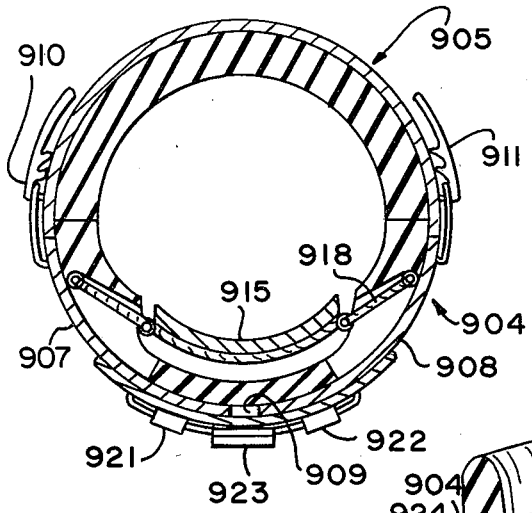
FIG. 41 is a cross-sectional view taken along lines 41—41 of FIG. 40.
Figure 40:
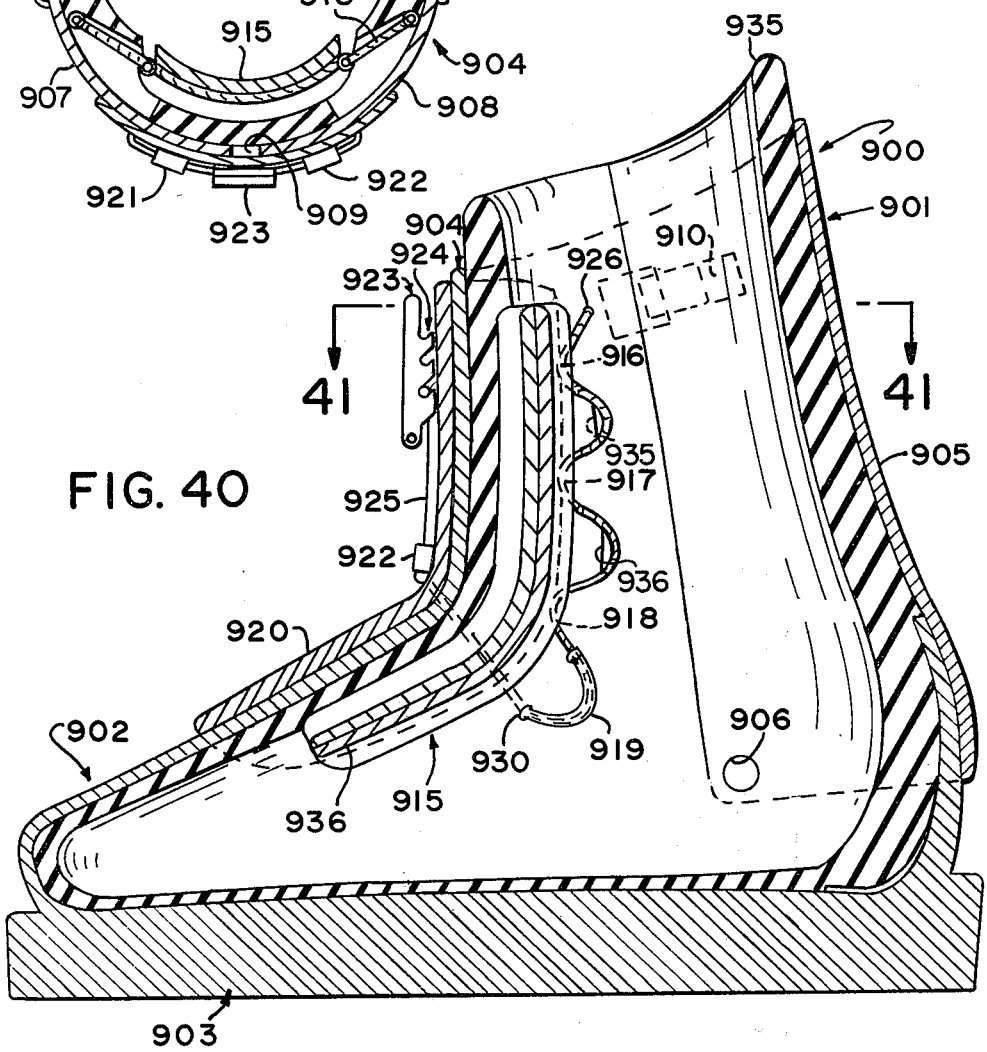
FIG. 40 is a cross-sectional view of another embodiment of the present invention.
Figure 43:
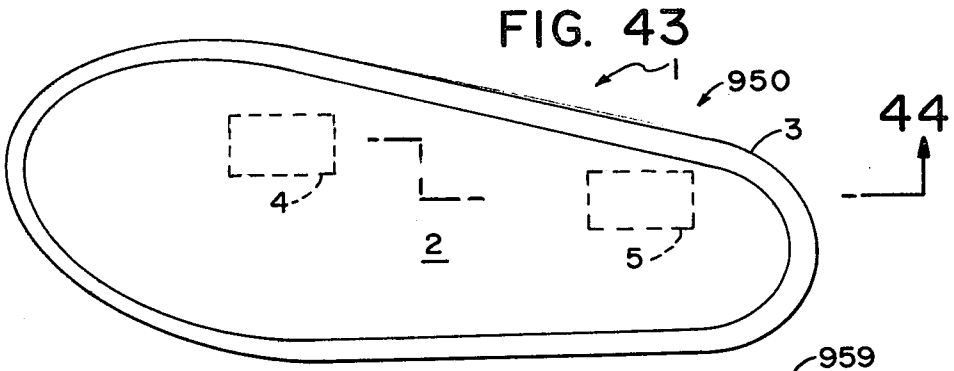
FIG. 43 is a partial plan view of another embodiment of the present invention.
Figure 42:
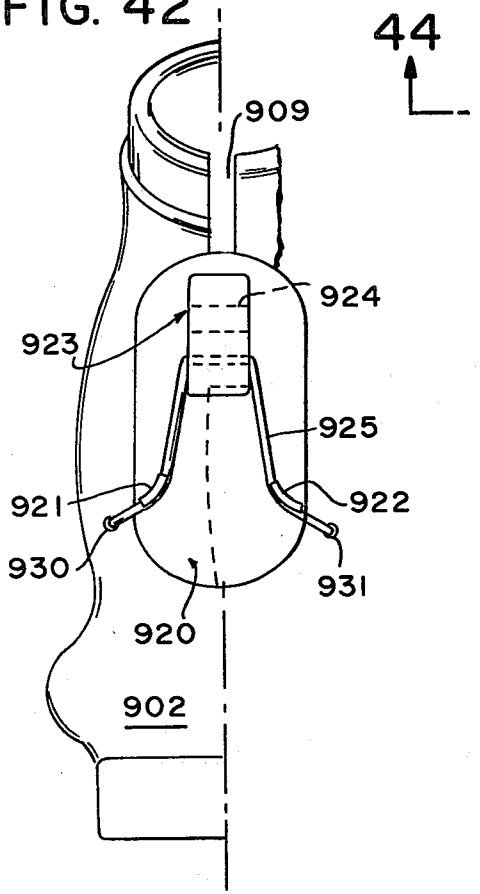
FIG. 42 is a partial front view of the embodiment of FIG. 40.

Referring to FIGS. 40–42 there is provided in a ski boot designated generally as 900 an upper cuff member 901, a lower shell member 902 and a sole member 903. The cuff member 901 comprises a forward section 904 and a rearward section 905. The forward section 904 is continuous with the lower shell member 902. The rearward section 905 is pivotally coupled to the shell 902 by means of a rivet or the like 906.

As seen more clearly in FIG. 41, the front section 904 is split into a right half 907 and a left half 908. Between the halves 907 and 908 there is provided a clearance space 909.

To close and lock the rearward section 905 to the forward section 904, there is provided along the medial and lateral sides of the cuff member 901 a pair of overcenter buckle assemblies 910 and 911.

In the interior of the cuff member 901 there is provided an interior tongue member 915. The tongue member 915 extends from near the top of the cuff member 901 downwardly and curves forwardly to cover the lower extremity. The lateral edges of the interior tongue member 915 curve downwardly and rearwardly, forming a concave surface for engaging the forward part of the leg, instep, and foot.

For warmth and comfort there is further provided in the interior of the boot 900 a soft resilient liner 935. A pad 936 of similar material is also provided on the interior tongue member 915 for providing warmth and comfort.

At spaced locations along the lateral edges of the tongue member 915 there is provided a plurality of cable guide members 916, 917 and 918. Below the cable guide 918 there is provided, attached to the shell 902, a cable guide tube 919.

Located on the exterior of the shell 902 and the forward cuff section 904 there is provided an exterior tongue member 920. On opposite sides of the midline of the exterior tongue member 920 there is provided a pair of cable guide members 921 and 922. Located above the guide member 921 and 922 there is provided an overcenter buckle member 923. In the buckle member 923 there is provided a plurality of cable receiving slots 924 for receiving a cable 925.

One end of the cable 925 is attached to the right side of the cuff 901 at a point designated 926. From the attachment point 926, the cable 925 is routed through the cable guide members 916, 917 and 918 on the right side of the interior tongue member 915, and intermediate guide members 935 and 936 attached to the interior wall of the cuff 901, through the cable guide tube 919 on the right side of the interior tongue member 915 and through a bore 930 provided therefor in the shell 902 on the right side of the interior tongue member 915. From the bore 930 the cable 925 is routed to the right guide member 921 and into one of the plurality of cable receiving slots 924 in the buckle assembly 923. From the buckle assembly 923, the cable 925 is routed past the left cable guide member 922. From the cable guide member 922 the cable 925 is passed through a bore 931 in the shell 902 on the left side of the interior tongue member 915. From the bore 931 the cable 925 is routed through a cable guide tube 919 on the left side of the interior tongue member 915 and through a set of cable guide members 916, 917 and 918 on the left side of the interior tongue member 915 corresponding to members 916, 917 and 918 and guide members 935 and 936 attached to the left interior wall of the cuff 901 as described above. On the upper cable guide member 916 on the left side of the interior tongue member 915, the cable 925 is extended and attached to the left side of the forward section of the cuff 904 at a point corresponding to the point 926.

To enter the boot 900, the buckle assemblies 910 and 911 are loosened. As the buckle assemblies 910 and 911 are loosened, the rear section 905 of the cuff member 901 is free to rotate rearwardly, opening the interior of the boot 900. As the interior of the boot 900 is opened, and a foot is inserted therein, the rear section 905 is closed and buckled by means of the buckle assemblies 910 and 911 to the forward section 904. Once the rearward section 905 is secured to the forward section 904, the position of the interior tongue 915 is adjusted by means of the cable 925 and the buckle assembly 923 until there is a close, comfortable fit.

With a close, comfortable fit, forward pressure on the interior tongue member 915 as during a turning maneuver will result in an increased tension applied to the cable 925. Because of a block and tackle effect resulting from the manner in which the cable 925 is coupled to the interior tongue member 915, any movement of the interior tongue member 915 will result in a larger movement of the exterior tongue member 920. As the tension on the cable 925 increases, the exterior tongue member 920 is pulled rearwardly and downwardly. As the exterior tongue member 920 is pulled rezrwardly and downwardly, the section 907 and 908 of the forward cuff section 904 are drawn together, closing the gap 909 therebetween, As the cuff sections 907 and 908 are drawn together, there is momentary tightening of the close fit.

Figure 44:
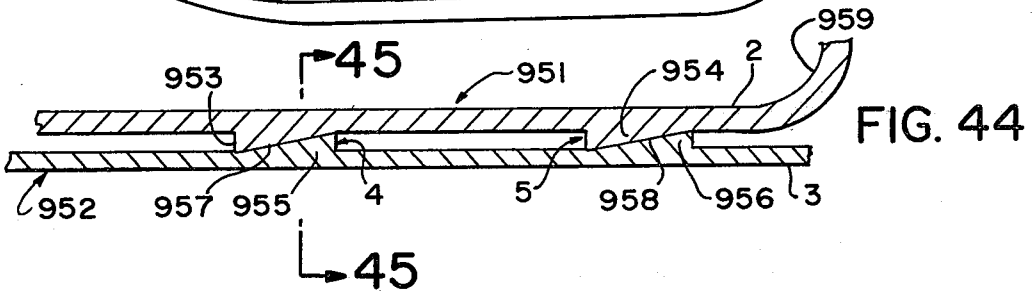
FIG. 44 is a cross-sectional view taken along lines 44—44 of FIG. 43.
Figure 45:
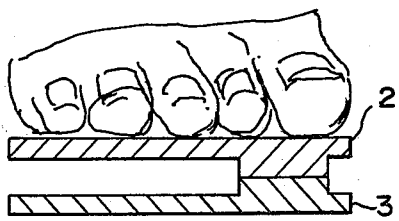
FIG. 45 is a cross-sectional view taken along lines 45—45 of FIG. 44.
Figure 46:
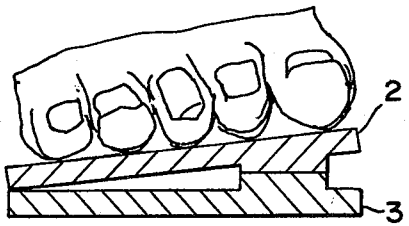
FIG. 46 is a cross-sectional view taken along lines 45—45 of FIG. 44 with the footbed moved rearwardly of the lower sole member.

Referring to FIGS. 44–46, there is provided in another embodiment of the present invention a sport shoe designated generally as 950. In the sport shoe 950 there is provided a movable footbed 951 supported on a sole member 952. On the medial side of the longitudinal axis of the footbed 951 and extending downwardly thereform, there is provided a plurality of wedge shaped members 953 and 954. Extending upwardly from the sole member 952 and in facing relationship with the wedge members 953 and 954 there is provided a corresponding number of wedge shaped members 955 and 956. Each of the wedge shaped members 953–956 have facing surfaces 957 and 958 which slope upwardly and rearwardly.

At the rear of the footbed 951 there is provided a heel receiving member 959 for receiving a wearer's heel.

In use, as a wearer is jogging or running and brings pressure to bear on the footbed 951 and rearward pressure to bear on the heel receiving member 959, the footbed 951 is forced rearwardly relative to the sole member 952. As the footbed 951 is forced rearwardly relative to the sole 952, the wedge shaped members 953–956 cause the footbed 951 to move upwardly and rotate about an axis parallel to the longitudinal axis of the footbed. This upward and rotational motion of the footbed 951 as shown more clearly in FIG. 46 compensates for the natural rotation of a foot during normal jogging and walking, thereby facilitating jogging and walking.

Several embodiments of the present invention are described and others are suggested. It is contemplated that still other modifications and changes will occur to those skilled in the art and can be made to the embodiments described without departing from the spirit and scope of the present invention. Accordingly, it is intended that the present invention not be limited to the embodiments described, but rather that the scope thereof be determined by reference to the claims and their equivalents hereafter provided.

What is claimed is:

1. A sport shoe for a lower extremity comprising fitting means for providing a close fit between the shoe and the lower extremity; tightening means responsive to a predetermined movement of the wearer of the shoe for momentarily increasing the tightness of the close fit established by the fitting means; and means for preventing a loosening of the fitting means.

2. A sport shoe according to claim 1 wherein the tightening means is responsive to a predetermined movement of the lower extremity.

3. A sport shoe according to claim 2 wherein the tightening means is responsive to a predetermined movement of a leg relative to a foot of the lower extremity.

4. A sport shoe according to claim 3 wherein the tightening means is responsive to a predetermined forward movement of the leg relative to the foot.

5. A sport shoe according to claim 3 wherein the means for preventing a loosening of the fitting means comprises means for preventing rearward movement of the leg from the relative position of the leg at which the close fit is established.

6. A sport shoe according to claim 1 wherein the tightening means is located internally of the shoe.

7. A sport shoe according to claim 1 including means for adjusting the tightening means for varying the closeness of the fit.

8. A sport shoe according to claim 1 wherein the tighening means includes means for momentarily increasing the tightness of the close fit between the shoe and a foot of the lower extremity.

9. A sport shoe according to claim 8 wherein the tightening means includes means for momentarily increasing the tightness of the close fit between the shoe and an instep and a heel of a foot of the lower extremity.

10. A sport shoe according to claim 8 wherein the fitting means comprises movable means for engaging the foot.

11. A sport shoe according to claim 10 wherein the tightening means comprises a cable and a pulley assembly operatively coupling the fitting means with the shoe.

12. A sport shoe according to claim 11 wherein the pulley assembly includes a pulley rotatably mounted to the shoe; means for attaching one end of the cable to the movable foot engaging means; means for attaching another end of the cable to the pulley so that a portion of the cable is wound about a portion of the pulley; means for adjusting the amount of cable wound on the pulley; and means for releasably locking the pulley to the shoe.

13. A sport shoe according to claim 1 wherein the fitting means is located internally of the shoe.

14. A sport shoe according to claim 1 wherein the fitting means comprises movable means engaging an upper surface of a foot of the lower extremity.

15. A sport shoe according to claim 14 wherein the movable foot engaging means includes means defining a strap.

16. A sport shoe according to claim 15 wherein the tightening means momentarily increases the tightness of the fit between the strap and the foot.

17. A sport shoe according to claim 15 wherein the movable foot engaging means further comprises:

a second strap;

means defining a link;

means for attaching first ends of the first and second straps to the shoe;

means for attaching second ends of the first and second straps to the link;

a tensioning member having a first end attached to the link; and means coupled to an opposite end of the tensioning member for momentarily tightening the first and second straps in response to the movement of the wearer.

18. A sport shoe according to claim 17 wherein the link is elongaged, and including means for attaching the ends of the first and second straps to opposite ends of the link, and means for attaching the first end of the tensioning member to the link at a location intermediate the position of attachment of the first and second straps to the link.

19. A sport shoe according to claim 18 including means for attaching the first strap to a portion of the shoe which is provided for receiving and supporting the fore foot, means for attaching the second strap to a portion of the shoe which is provided for receiving and supporting the hind foot, and means for pivotally attaching the first and second strap means to the link.

20. A sport shoe according to claim 1 wherein the tightening means includes means for momentarily increasing the tightness of the close fit between the shoe and a leg of the lower extremity.

21. A sport shoe according to claim 20 wherein the fitting means comprises movable means for engaging the leg.

22. A sport shoe according to claim 21 wherein the tightening means comprises a cable and a buckle assembly including buckle means attached to the cuff means for pivotable movement between first and second positions about a generally horizontal axis; means connecting the ends of the cable to the cuff means; and means for routing the cable from the cuff means to the buckle means for closing the cuff means about the leg by pivoting the buckle means.

23. A sport shoe according to claim 22 wherein the tightening means includes means for momentarily increasing the tightness of the close fit between the cuff and the leg.

24. A sport shoe according to claim 1 wherein the fitting means comprises movable means engaging the lower extremity, including movable means engaging a foot and movable means engaging a leg of the lower extremity.

25. A sport shoe according to claim 24 wherein the foot engaging means comprises a movable footbed and the leg engaging means comprises a movable cuff.

26. A sport shoe according to claim 25 wherein the tightening means includes means for momentarily lifting the footbed towards the foot and means for momentarily drawing together the cuff about the leg.

27. A sport shoe according to claim 26 wherein the tightening means comprises a cable and a pulley assembly operatively coupling the cuff and the footbed so that the footbed and the cuff are simultaneously tightened.

28. A sport shoe according to claim 27 wherein the tightening means further includes a motor assembly for activating the pulley assembly in response to a predetermined movement of the lower extremity.

29. A sport shoe according to claim 26 wherein the tightening means includes means responsive to a predetermined movement of the cuff for lifting the footbed.

30. A sport shoe according to claim 29 wherein the tightening means includes means for momentarily drawing together the cuff in response to a predetermined movement of the footbed.

31. A sport shoe according to claim 1 including a cuff forming part of the shoe; interior tongue means movably mounted interiorly of the cuff; exterior tongue means movably mounted exteriorly of the cuff; a cable connected with the interior tongue means; means attaching a first portion of the cable to the cuff; and means for attaching a second portion of the cable to the exterior tongue means so that relative movement of the interior tongue means momentarily tightens the exterior tongue means.

32. A sport shoe according to claim 10 wherein the fitting means comprises movable means engaging a lower surface of the foot.

33. A sport shoe according to claim 32 wherein the movable means comprises a movable footbed.

34. A sport shoe according to claim 33 wherein the tightening means includes means for momentarily increasing the tightness of the footbed on the foot.

35. A sport shoe according to claim 34 wherein the tightening means includes means for momentarily lifting the footbed.

36. A sport shoe according to claim 35 wherein the means for lifting the footbed includes a rotatable shaft and cam means extending radially from the shaft for lifting the footbed when the shaft is rotated.

37. A sport shoe according to claim 36 including means for rotating the shaft comprising motor driven means operatively coupled with the shaft, and wherein the cam means comprises a plate member extending from the shaft for lifting the footbed.

38. A sport shoe according to claim 35 wherein the lifting means comprises movable piston means engaging the footbed.

39. A sport shoe according to claim 35 wherein the lifting means comprises cooperating inclined surfaces connected to the footbed and the shoe.

40. A sport shoe according to claim 35 wherein the tightening means includes means for momentarily moving the footbed about an axis generally parallel to the longitudinal axis of the sport shoe when the footbed is lifted.

41. A sport shoe according to claim 35 wherein the tightening means includes means for momentarily moving the footbed in a longitudinal direction when the footbed is lifted.

42. A sport shoe according to claim 41 wherein the longitudinal moving means includes cooperating inclined surfaces located proximate an aft end of the footbed.

43. A sport shoe according to claim 41 wherein the longitudinal moving means includes a rigid member and means for connecting one end of the rigid member to an interior wall of the sport shoe and means for connecting an opposite end of the rigid member to an aft end of the footbed, whereby the rigid member moves the footbed longitudinally in a forward direction when the footbed is lifted.

44. A sport shoe according to claim 43 wherein the movable footbed includes:

means for engaging a lateral edge of a foot;

means for engaging rear and lateral edges of a heel of the foot;

means for engaging a medial edge of a ball of the foot;

means for engaging a front edge of the foot between toes thereof;

means for engaging a medial edge of the heel of the foot; and means for adjusting the distance between selected, opposing ones of the engaging means.

45. A sport shoe for a lower extremity comprising a lower shell and an upper cuff movably connected with the shell; fitting means providing a close fit between the shoe and the lower extremity when the shell and the cuff are in a first relative position; tightening means for tightening the fitting means in response to a relative movement between the upper cuff and the lower shell for momentarily increasing the tightness of the fitting means when the cuff and the shell move with respect to each other from the first position in a first direction; and means for preventing a loosening of the fitting means when the cuff and the shell move with respect to each other from the first position in a second direction.

46. A sport shoe according to claim 45 wherein the preventing means comprises means preventing rearward movement of the upper cuff from the first position.

47. A sport shoe according to claim 46 wherein the fitting means is disposed internally of the lower shell.

48. A sport shoe comprising a lower shell, an upper cuff movably attached to the shell; at least one strap disposed interiorly of the shoe and located to engage an upper surface of a foot disposed in the shoe means connecting a first end of the strap with the shoe; means connecting a second end of the strap with the shoe; and means disposed between at least one end of the strap and the shoe for tightening the strap against the foot in response to a predetermined relative movement between the cuff and the shell in a first directon and for loosening the strap in response to a predetermined movement between the shell and the cuff in a second, generally opposite direction.

49. A sport shoe according to claim 48 including first and second, generally parallel, spaced apart straps positioned to engage the upper surface of the foot, and means pivotally attached to adjacent ends of the straps for increasing the force with which one of the straps engages the foot when the force with which the other strap engages the foot increases.

50. A sport shoe according to claim 48 wherein the means for tightening comprises a pulley rotatably mounted to the shell, means coupling the pulley to the cuff so that relative motion of the cuff imparts a corresponding rotational motion to the pulley; and a cable anchored to the pulley and connected with the strap for tightening the strap against the foot.

51. A sport shoe comprising a lower shell; an upper cuff movably attached to the lower shell; first and second straps disposed interiorly of the shell for engaging an upper surface of a foot disposed in the shoe; means connecting proximate first ends of the straps with the shoe; and means connecting second, proximate ends of the straps with the shoe, the second ends connecting means including an elongated link pivotally attached to the second ends of the straps, and a cable having a first end pivotally attached to the link at a point intermediate the points of attachment of the straps, and a second end attached to the shoe so that the straps apply a force against the upper surface of a foot when disposed in the shoe; whereby relative movement of one of the straps in response to movement of the lower extremity in the boot increases the force applied by such strap against the foot and pivots the link about the cable attachment point and thereby causes a corresponding increase in the force applied against the foot by the second strap.

52. A sport shoe according to claim 51 including means for varying the effective length of the cable to thereby adjust the force with which the straps engage the foot in the shoe.

53. A sport shoe comprising a shell for receiving a portion of a lower extremity including a foot and part of a leg and defining a sole of the shoe; a generally rigid footbed disposed in the shoe generally above the sole thereof; means defining a transverse axis about which the footbed pivots; footbed moving means engaging a side of the footbed facing the sole for raising and lowering the footbed relative to the shell to correspondingly increase and decrease the tightness with which the shoe engages the foot; and means operatively coupled with the moving means for sensing predetermined movements of the lower extremity and correspondingly activating the moving means to raise and lower the footbed to thereby change the tightness of the fit of the shoe as a function of the predetermined movement of the lower extremity.

54. A sport shoe according to claim 53 wherein the moving means includes a piston operatively coupled with the sole and the footbed.

55. A sport shoe comprising a shell and a cuff movably attached to the shell; a footbed disposed within the shoe generally above the sole; means coupling an aft end of the footbed with the cuff so that relative movement of the cuff in a forward direction raises the aft end of the footbed and thereby temporarily increases the tightness of the fit of the shoe on the foot; and means carried by the footbed and the shell for inducing a forward motion of the footbed relative to the shell as a result of the raising of the footbed relative to the shell to thereby further increase the tightness of the fit.

56. A sport shoe according to claim 55 including inclined surfaces on the sole and the footbed for raising a forward portion of the footbed in response to the forward motion thereof.

57. A shoe according to claim 56 wherein the inclined surfaces are disposed proximate one lateral side only of the footbed and the sole so that forward motion of the footbed additionally results in a relative tilting of the footbed about a longitudinal axis thereof.

58. A sport shoe comprising a lower shell including a sole, an upper cuff, means permitting relative pivotal movement between the cuff and the shell about a transverse axis from a rest position towards a position in which the cuff is forwardly inclined relative to its rest position; the cuff having a generally tubular configuration and overlapping ends which can be drawn together and pulled apart to correspondingly vary the tightness with which the cuff engages a leg of a lower extremity disposed in the shoe; a footbed in the shoe generally above the sole; and cable means operatively coupled with the footbed, the shell and the cuff so that relative forward pivotal movement of the cuff raises the footbed with respect to the sole to thereby increase the tightness with which the foot is engaged by the shoe and simultaneously draws together the overlapping ends of the cuff to increase the tightness with which the cuff engages the leg.

59. A sport shoe according to claim 58 including motor driven means operatively coupled with the cable means for adjusting the effective length of the cable means; and transducer means carried by the boot for sensing a predetermined movement of the wearer's leg operatively coupled with the motor means for activating the latter and changing the tension in the cable means to thereby correspondingly change the tightness of the fit of the shoe on the lower extremity.

60. A sport shoe comprising a lower shell including a sole; an upper cuff pivotally mounted to the shell for pivotal movement from a rest position in a forward direction about an axis extending transversely across the boot; a footbed disposed in the shoe generally above the sole; cam means disposed between the sole and the footbed and fixed relative to the cuff for pivotal movement therewith and for engaging and raising the footbed relative to the sole during pivotal movement of the cuff in a forward direction; and strap means extending across an upper surface of the foot and having ends attached to the shell so that the raising of the footbed increases the force with which the strap engages the foot and thereby temporarily increases the tightness of the fit of the shoe on the foot as a function of the forward movement of the cuff from its rest position.

* * * * *